US007271798B2

(12) United States Patent
Masubuchi et al.

(10) Patent No.: US 7,271,798 B2
(45) Date of Patent: Sep. 18, 2007

(54) LIQUID CRYSTAL EXPOSURE DEVICE

(75) Inventors: Sadao Masubuchi, Chofu (JP); Masafumi Yokoyama, Tokyo (JP); Makoto Yasunaga, Kawagoe (JP); Masaaki Matsunaga, Tokyo (JP)

(73) Assignee: Citizen Holdings Co., Ltd., Nishi-Tokyo (JP)

( * ) Notice: Subject to any disclaimer, the term of this patent is extended or adjusted under 35 U.S.C. 154(b) by 425 days.

(21) Appl. No.: 10/492,354

(22) PCT Filed: Aug. 14, 2003

(86) PCT No.: PCT/JP03/10358

§ 371 (c)(1),
(2), (4) Date: Apr. 13, 2004

(87) PCT Pub. No.: WO2004/016437

PCT Pub. Date: Feb. 26, 2004

(65) Prior Publication Data

US 2005/0200614 A1 Sep. 15, 2005

(30) Foreign Application Priority Data

Aug. 14, 2002 (JP) ..... 2002-236317
Aug. 14, 2002 (JP) ..... 2002-236331

(51) Int. Cl.
*G09G 5/00* (2006.01)

(52) U.S. Cl. ..... 345/204; 345/211; 345/212

(58) Field of Classification Search ..... 345/87, 345/89, 102, 147, 7, 212, 204, 211, 44, 76, 345/77, 47; 359/2, 35, 567, 13, 14, 34; 250/330; 348/333.01; 355/40; 349/2
See application file for complete search history.

(56) References Cited

U.S. PATENT DOCUMENTS 4,581,619 A 4/1986 Mizutome et al.

(Continued)

FOREIGN PATENT DOCUMENTS

JP 63-124218 8/1988

(Continued)

OTHER PUBLICATIONS

Supplementary European Search Report mailed Jun. 22, 2007 for Application No. EP 03788118 from the European Patent Office.

*Primary Examiner*—Bipin Shalwala
*Assistant Examiner*—Prabodh Dharia
(74) *Attorney, Agent, or Firm*—Finnegan, Henderson, Farabow, Garrett & Dunner, L.L.P.

(57) ABSTRACT

A color liquid crystal exposure apparatus includes a color light source for emitting a plurality of colored light beams, a liquid crystal shutter having a plurality of liquid crystal pixels arrayed in a direction orthogonal to the direction of the relative movement, and a driving circuit for switching the color light source from one color to another, and for driving the plurality of liquid crystal pixels. The plurality of liquid crystal pixels are divided into a plurality of pixel groups. The liquid crystal pixels in each pixel group are arrayed, one displaced from another by a prescribed distance, in the direction orthogonal to the direction of the relative movement. The driving circuit drives the plurality of liquid crystal pixels in time-division fashion so that the liquid crystal pixels having the same displaced position in the plurality of pixel groups are driven at one time.

19 Claims, 24 Drawing Sheets

U.S. PATENT DOCUMENTS 4,958,912 A * 9/1990 Inaba et al. ..... 349/2
5,856,814 A * 1/1999 Yagyu ..... 345/89
5,892,598 A * 4/1999 Asakawa et al. ..... 359/13
5,933,213 A * 8/1999 Siemer et al. ..... 355/40
6,281,923 B1 8/2001 Yamada et al.
6,437,769 B1 * 8/2002 Kobayashi et al. ..... 345/102
6,757,020 B1 * 6/2004 Kikuchi ..... 348/333.01
6,806,983 B2 * 10/2004 Long ..... 359/35
6,825,469 B2 * 11/2004 Yamaguchi et al. ..... 250/330

FOREIGN PATENT DOCUMENTS

JP 9-123526 5/1997
JP 11-198443 7/1999

* cited by examiner

LIQUID CRYSTAL EXPOSURE DEVICE

BACKGROUND ART

The present invention relates to a liquid crystal exposure apparatus. More particularly, the invention relates to a color liquid crystal exposure apparatus equipped with a liquid crystal shutter which controls the transmission of light from a color light source and thereby controls color exposures on a photosensitive member such as photographic paper.

PRIOR ART

In the prior art, it is known to provide an exposure apparatus for recording an image on a photosensitive member in, for example, an exposure apparatus or an optical printing apparatus that forms a latent image or a color image on a photosensitive member by controlling the amount of transmission of light from a light source such as a light-emitting diode by means of a liquid crystal shutter. Generally, in this type of apparatus, three kinds of light, i.e., the three primary colors red (R), green (G), and blue (B), are projected from light sources toward the photosensitive member. Further, in this type of apparatus, a liquid crystal shutter is placed in a light path, and the photosensitive member is moved relative to the liquid crystal shutter at a position in close proximity to the liquid crystal shutter. Furthermore, the opening and closing of each cell (liquid crystal pixel) in the liquid crystal shutter is controlled in accordance with image data and in synchronism with the movement of the photosensitive member. By controlling the amount of transmission of each color of the light for exposure on the photosensitive member, a proper image can be formed on the photosensitive member.

One example of the prior art optical printing apparatus is described in Japanese Unexamined Patent Publication No. H07-256928. It is disclosed in this document that white light projected from a single light source is divided into the three colors red, green, and blue, that the three colors are directed to a black-and-white shutter array comprising three liquid crystal pixel arrays corresponding to the red, green, and blue colors, respectively, and that the colored light passed through the black-and-white shutter array is focused through a converging lens array onto photographic paper to produce a print image.

A modified optical print head for the above optical printing apparatus is described in Japanese Unexamined Patent Publication No. 2000-280527. This document discloses an optical print head that achieves a reduction in apparatus cost by using a light source comprising red, green, and blue LED lamps and a black-and-white shutter array comprising a liquid crystal pixel array with a plurality of liquid crystal pixels arranged in a single array (for one color) along the main scanning direction.

However, in the optical printer described in Japanese Unexamined Patent Publication No. 2000-280527, as each individual liquid crystal pixel in the black-and-white shutter array is driven by a driver IC, there has been the problem that the number of driver ICs becomes large, preventing a further reduction in cost.

DISCLOSURE OF THE INVENTION

It is an object of the present invention to provide a liquid crystal exposure apparatus equipped with an optical print head that can achieve a reduction in cost.

It is another object of the present invention to provide a color liquid crystal exposure apparatus equipped with a liquid crystal shutter array that can reduce the number of required driver ICs.

It is a further object of the present invention to provide a color liquid crystal exposure apparatus that is equipped with an optical print head and a liquid crystal shutter constructed from a single array of liquid crystal pixels, and that achieves a reduction in cost by reducing the number of driver ICs for driving the liquid crystal shutter.

A liquid crystal exposure apparatus according to the present invention, which achieves the above objects, has a color light source for emitting a plurality of colored lights, a liquid crystal shutter having a plurality of liquid crystal pixels arrayed in a direction orthogonal to the direction of relative movement, and a driving circuit for switching the color light source from one colored light to another and for driving the plurality of liquid crystal pixels, wherein the plurality of liquid crystal pixels are divided into a plurality of pixel groups of N liquid crystal pixels each, the N liquid crystal pixels in each pixel group being arrayed, one displaced from another by a prescribed distance, in the direction orthogonal to the direction of the relative movement, and the driving circuit drives a plurality of liquid crystal pixels having the same displaced position in the plurality of pixel groups at a time in time-division fashion. According to the liquid crystal exposure apparatus of the present invention, as the liquid crystal pixel array is divided into a plurality of pixel groups of N liquid crystal pixels each, and each pixel group is driven by a driver IC, the number of driver ICs can be reduced to 1/N compared with the case where each individual liquid crystal pixel is driven by a driver IC, and thus the cost of the liquid crystal exposure apparatus can be reduced.

Preferably, in the liquid crystal exposure apparatus according to the present invention, each of the plurality of liquid crystal pixels has a first electrode and a second electrode, the first electrodes of the plurality of liquid crystal pixels are connected in common to the driving circuit, the second electrodes of the liquid crystal pixels having the same displaced position in the plurality of pixel groups are all connected to a corresponding one of N time-division lines, and the driving circuit drives the plurality of liquid crystal pixels in time-division fashion by switching between the N time-division lines.

Preferably, in the liquid crystal exposure apparatus according to the present invention, the driving circuit switches the color light source from one color to another while any particular one of the time-division lines is selected.

Preferably, in the liquid crystal exposure apparatus according to the present invention, the write period WF required to complete the exposure of the photosensitive member by all of the liquid crystal pixels of the pixel groups is equal to the sum of the selection periods of all of the time-division lines.

Preferably, in the liquid crystal exposure apparatus according to the present invention, the driving circuit switches the color light source from one color to another in a time equal to an Mth submultiple of the selection period of each of the time-division lines, where M denotes the number of colored lights that the color light source emits.

Preferably, in the liquid crystal exposure apparatus according to the present invention, the distance H by which the liquid crystal pixels are displaced in each of the pixel groups satisfies the relation $H=h/N$, where h denotes the distance over which the photosensitive member relatively moves during the write period, and N the number of liquid crystal pixels in each of the pixel groups.

Further preferably, in the liquid crystal exposure apparatus according to the present invention which comprises the color light source for emitting the plurality of colored lights, the driving circuit switches between the time-division lines while any particular one of the colored lights of the color light source is selected.

Preferably, in the liquid crystal exposure apparatus according to the present invention, the write period WF required to complete the exposure of the photosensitive member by all of the liquid crystal pixels of the pixel groups is determined by the product of a division period F, during which the time-division lines are switched from one line to another, and the number, M, of colored lights that the color light source emits.

Preferably, in the liquid crystal exposure apparatus according to the present invention, the distance H by which the liquid crystal pixels are displaced from each other satisfies the relation H=h/NM, where h denotes the distance over which the photosensitive member relatively moves during the write period WF, N the number of liquid crystal pixels in each of the pixel groups, and M the number of colored lights that the color light source emits.

Preferably, in the liquid crystal exposure apparatus according to the present invention, the direction in which the liquid crystal pixels are displaced in each of the pixel groups is a downstream direction when viewed along the direction of the relative movement of the photosensitive member.

Preferably, in the liquid crystal exposure apparatus according to the present invention, the length of each of the liquid crystal pixels in the liquid crystal pixel array, as measured along the direction of the relative movement, is equal to the distance h over which the photosensitive member relatively moves during the write period WF.

Preferably, in the liquid crystal exposure apparatus according to the present invention, the number, M, of colored lights is 3, and the number, N, of liquid crystal pixels in each of the pixel groups is 3.

Preferably, in the liquid crystal exposure apparatus according to the present invention, the number, M, of colored lights is 3, and the number, N, of liquid crystal pixels in each of the pixel groups is 2.

Preferably, in the liquid crystal exposure apparatus according to the present invention, the number, M, of colored lights is 3, and the number, N, of liquid crystal pixels in each of the pixel groups is 4.

EMBODIMENTS OF THE INVENTION

Figure 1:
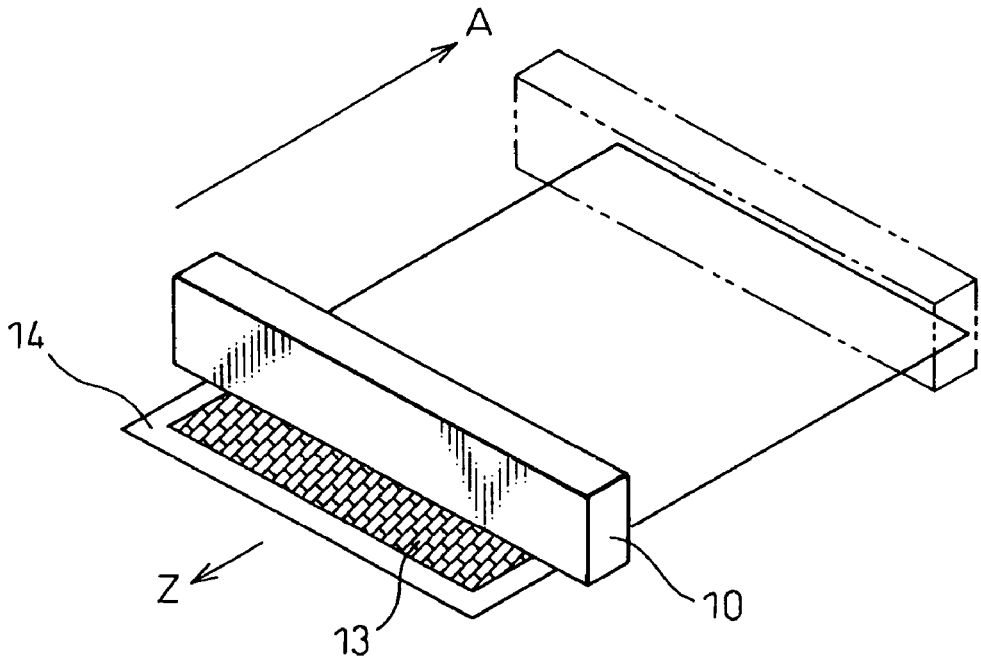
FIG. 1 is a perspective view for explaining the operation for forming a latent image on a photosensitive member by a color liquid crystal exposure apparatus containing a liquid crystal shutter.

FIG. 1 is a diagram for explaining the operation for forming a latent image 13 on a photosensitive member 14 by a color liquid crystal exposure apparatus 10 containing a liquid crystal shutter. This figure shows how the latent image 13 is formed on the photosensitive member 14 while the exposure apparatus 10 is being moved at a constant speed over the photosensitive member 14.

Figure 2A:
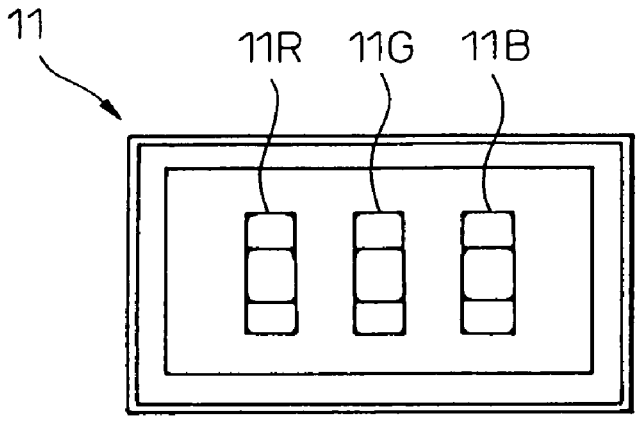
FIG. 2A is a diagram showing one example of a color light source.
Figure 2B:
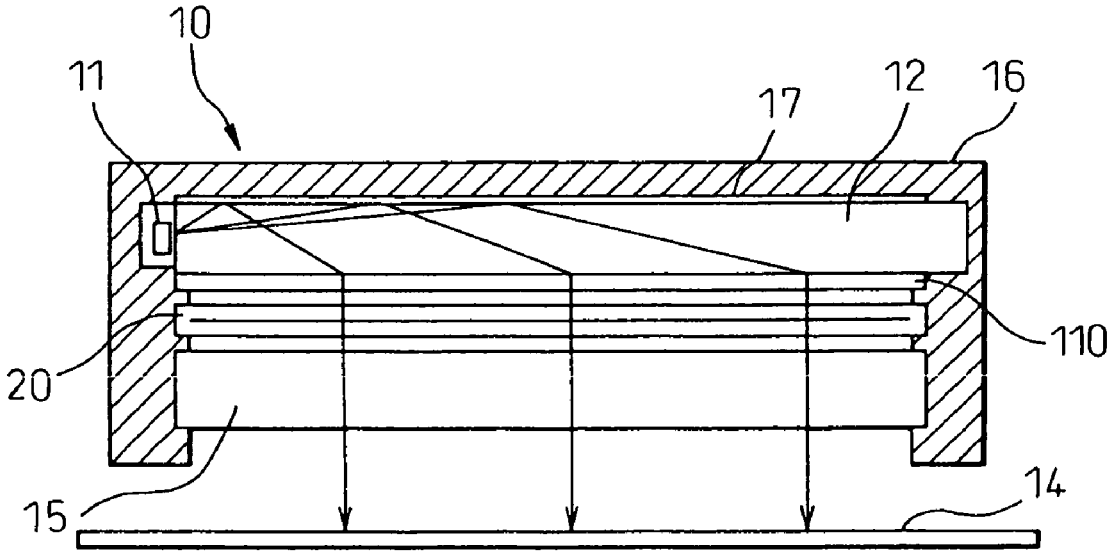
FIG. 2B is an explanatory diagram showing the internal construction of the color liquid crystal exposure apparatus.

FIG. 2A is a diagram showing a color light source 11 in the color liquid crystal exposure apparatus 10, and FIG. 2B is a diagram revealing the internal construction of the color liquid crystal exposure apparatus 10 by removing a side wall on one side thereof. Inside a housing 16 of the color liquid crystal exposure apparatus 10 are contained, for example, three color LEDs (light-emitting diodes) 11R, 11G, and 11B which together constitute the color light source 11. Light emitted from the color light source 11 is introduced into a light guiding member 12. The light guiding member 12 is constructed, for example, from a rod of acrylic resin whose cross section is rectangular in shape. A white reflecting plate 17 is placed on the upper surface of the light guiding member 12. The light introduced into the light guiding member 12 is reflected by the white reflecting plate 17 and distributed uniformly along the longitudinal direction of the color liquid crystal exposure apparatus 10, and emerges as a line illumination whose amount of light along the longitudinal direction is substantially uniform along the entire length of a liquid crystal shutter array 20 disposed under the light guiding member 12. The on/off control and switching control of the color light source 11 are performed by a driver circuit to be described later. The color light source 11 may be controlled using a control circuit provided separately from the driver circuit to be described later.

The liquid crystal shutter array 20 is constructed from a large number of black-and-white liquid crystal pixels (liquid crystal shutters) arranged in a straight line; when a liquid crystal pixel is in the black (off) state, the pixel blocks light, and when the liquid crystal pixel is in the white (on) state, the pixel allows light to pass through. The on/off control of the liquid crystal pixels is performed by the driver circuit to be described later. The light emerging from the light guiding member 12 is thus passed through liquid crystal pixels driven in the white state, and is focused through a converging lens array 15, disposed below the liquid crystal shutter array 20, to expose the photosensitive member 14. With the driver circuit thus performing control to switch the liquid crystal shutter array 20 on and off while also performing control to select the color of the light to be emitted by the color light source 11, a latent color image can be formed on the photosensitive member 14.

In the example of FIG. 1, the photosensitive member 14 is held fixed, and the color liquid crystal exposure apparatus 10 is transported by a transporting mechanism (not shown) at a constant speed in the direction of arrow A in the figure. Conversely, the color liquid crystal exposure apparatus 10 may be fixed, and the photosensitive member 14 may be transported by a transporting mechanism at a constant speed in the direction of arrow Z in the figure. The only requirement here is that either the color liquid crystal exposure apparatus 10 or the photosensitive member 14 be moved relatively to the other at a constant speed.

Figure 3A:
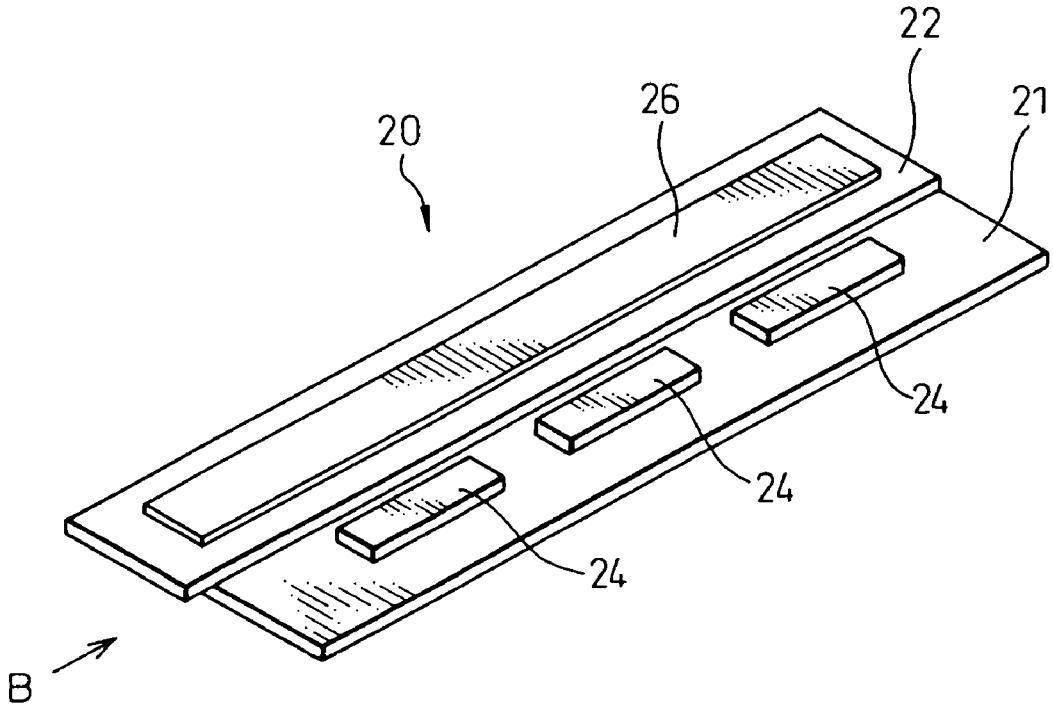
FIG. 3A is a perspective view showing the construction of a liquid crystal panel forming a liquid crystal shutter array.
Figure 3B:
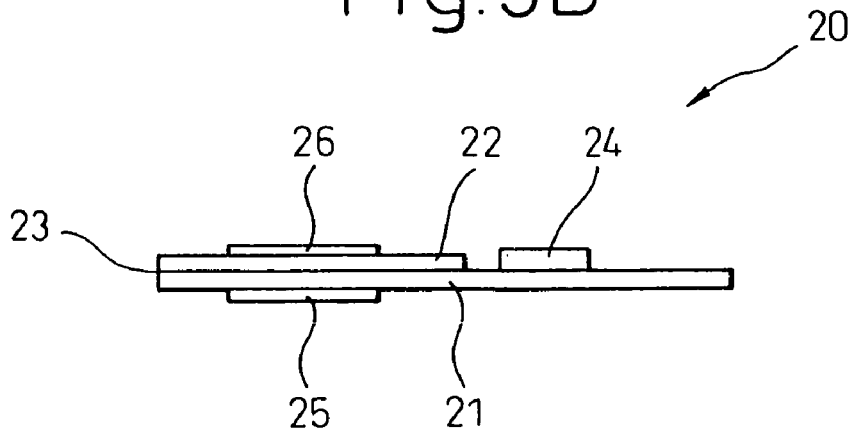
FIG. 3B is a side view in the direction of B in FIG. 3A.

FIG. 3A is a diagram showing the construction of the liquid crystal shutter array 20 shown in FIG. 2B, and FIG. 3B is a view in the direction of B in FIG. 3A. The liquid crystal shutter array 20 comprises a first liquid crystal cell substrate 21 located on the side (lower side in the figure) farther from the light guiding member 12 and a second liquid crystal cell substrate 22 located on the side (upper side in the figure) nearer to the light guiding member 12. The first liquid crystal cell substrate 21 is larger than the second liquid crystal cell substrate 22. First electrodes, second electrodes opposing the first electrodes, and a liquid crystal pixel array comprising a plurality of liquid crystal cells constructed from liquid crystals, etc. arranged between the first and second electrodes, are formed in areas 23 where the first liquid crystal cell substrate 21 and the second liquid crystal cell substrate 22 are bonded together. Driver ICs 24 for driving the liquid crystal cells are arranged on the portion of the first liquid crystal cell substrate 21 that does not overlap the second liquid crystal cell substrate 22. Polarizing plates 25 and 26 are arranged on the outside surfaces of the bonding portions 23 of the first and second liquid crystal cell substrates 21 and 22.

Figure 4A:
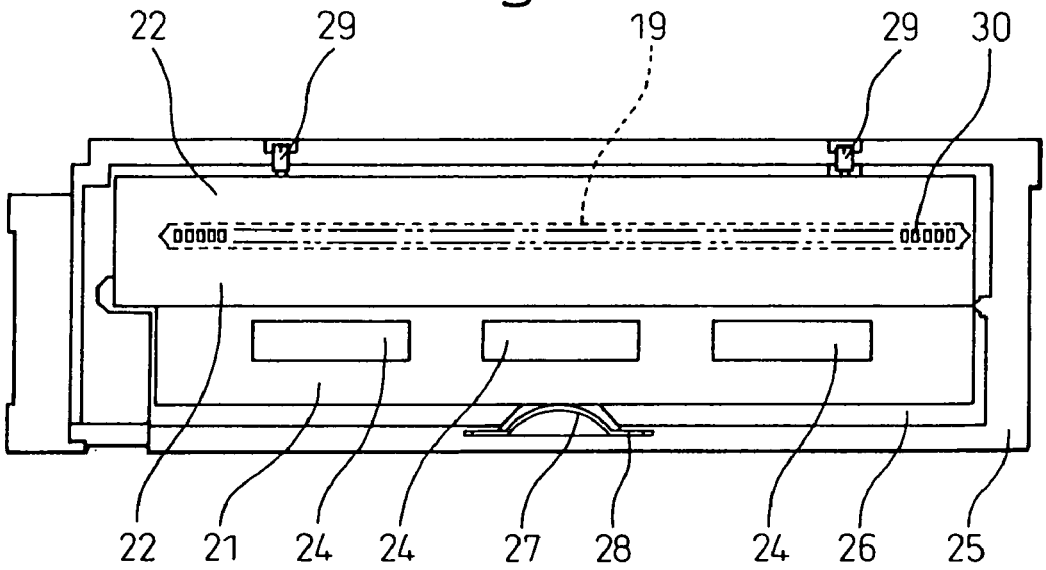
FIG. 4A is a plan view showing the condition in which the liquid crystal panel shown in FIG. 3 is assembled into a housing.

FIG. 4A shows the condition in which the liquid crystal shutter array 20 shown in FIG. 2 is assembled into an accommodating recess 26 of a base section 25 provided in the housing 16 of the color liquid crystal exposure apparatus 10. A curved plate spring 27 held in a holding portion 28 is provided on one side wall extending in the longitudinal direction of the accommodating recess 26, and adjusting screws 29 are attached at two places on the opposite side wall. An opening 19 through which the light emerging from the liquid crystal shutter array 20 is passed is formed in the bottom of the accommodating recess 26.

The liquid crystal shutter array 20 is inserted into the accommodating recess 26 by placing an edge portion of the first liquid crystal cell substrate 21 against the plate spring 27 in such a manner as to press the plate spring 27. Further, the liquid crystal shutter array 20 is accommodated in the accommodating recess 26 with an edge portion on the opposite side of the first liquid crystal cell substrate 21 held against the two adjusting screws 29. The liquid crystal pixel array 30 as the liquid crystal shutter is provided in the portion where the first liquid crystal cell substrate 21 and the second liquid crystal cell substrate 22 are bonded together. The position of the liquid crystal shutter array 20 in the accommodating recess 26 is adjusted by means of the adjusting screws 29 so that the center line of the liquid crystal pixel array 30 is aligned with the center line of the opening 19.

Figure 4B:
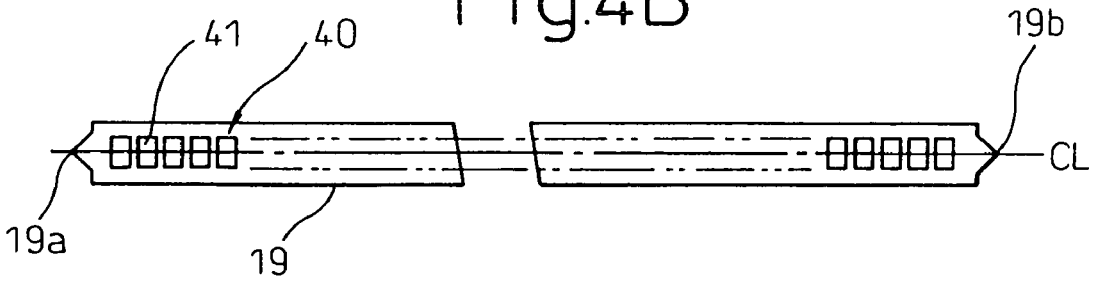
FIG. 4B is an enlarged view showing a prior art arrangement of a liquid crystal pixel array in the liquid crystal shutter shown in FIG. 4A.

FIG. 4B is a view showing in enlarged form a liquid crystal pixel array 40 and an opening 19 according to the prior art. The prior art liquid crystal pixel array 40 is constructed by arranging individual liquid crystal pixels 41 in a straight line. Further, end portions 19*a* and 19*b* of the opening 19 are formed triangular in shape with the line joining the two vertices being aligned with the center line CL of the opening 19. In the prior art, therefore, the position of the liquid crystal shutter array 20 in the accommodating recess 26 is adjusted by means of the adjusting screws 29 so that the center line of the liquid crystal pixel array 40 coincides with the center line CL of the opening 19, thereby ensuring that all the light passed through the liquid crystal pixel array 40 passes through the opening 19 and reaches the photosensitive member 14 without any portion of the light being blocked on the way.

(1) Embodiment 1

Figure 4C:
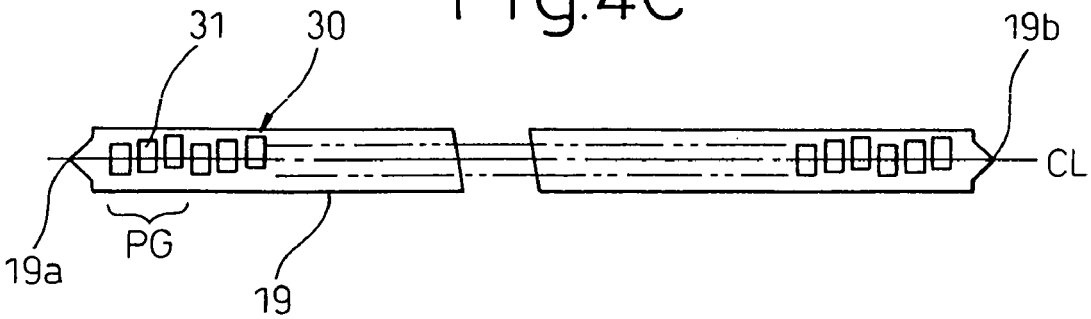
FIG. 4C is an enlarged view showing an arrangement of a liquid crystal pixel array according to the present invention, in the liquid crystal shutter shown in FIG. 4A.

FIG. 4C is a diagram showing a liquid crystal pixel array 30 and an opening 19 according to a first embodiment of the present invention. In this embodiment, liquid crystal pixels 31 constituting the liquid crystal pixel array 30 are divided into pixel groups PG of three pixels each, and the three liquid crystal pixels 31 in each pixel group PG are arranged one displaced from another by L/3 (L is the length of each liquid crystal pixel 31 measured along the direction of the relative movement of the photosensitive member).

In this embodiment, the position of the liquid crystal shutter array 20 in the accommodating recess 26 is adjusted by means of the adjusting screws 29 so that the line passing through the center of the middle liquid crystal pixel 31B in each pixel group PG coincides with the center line CL of the opening 19.

Figure 5:
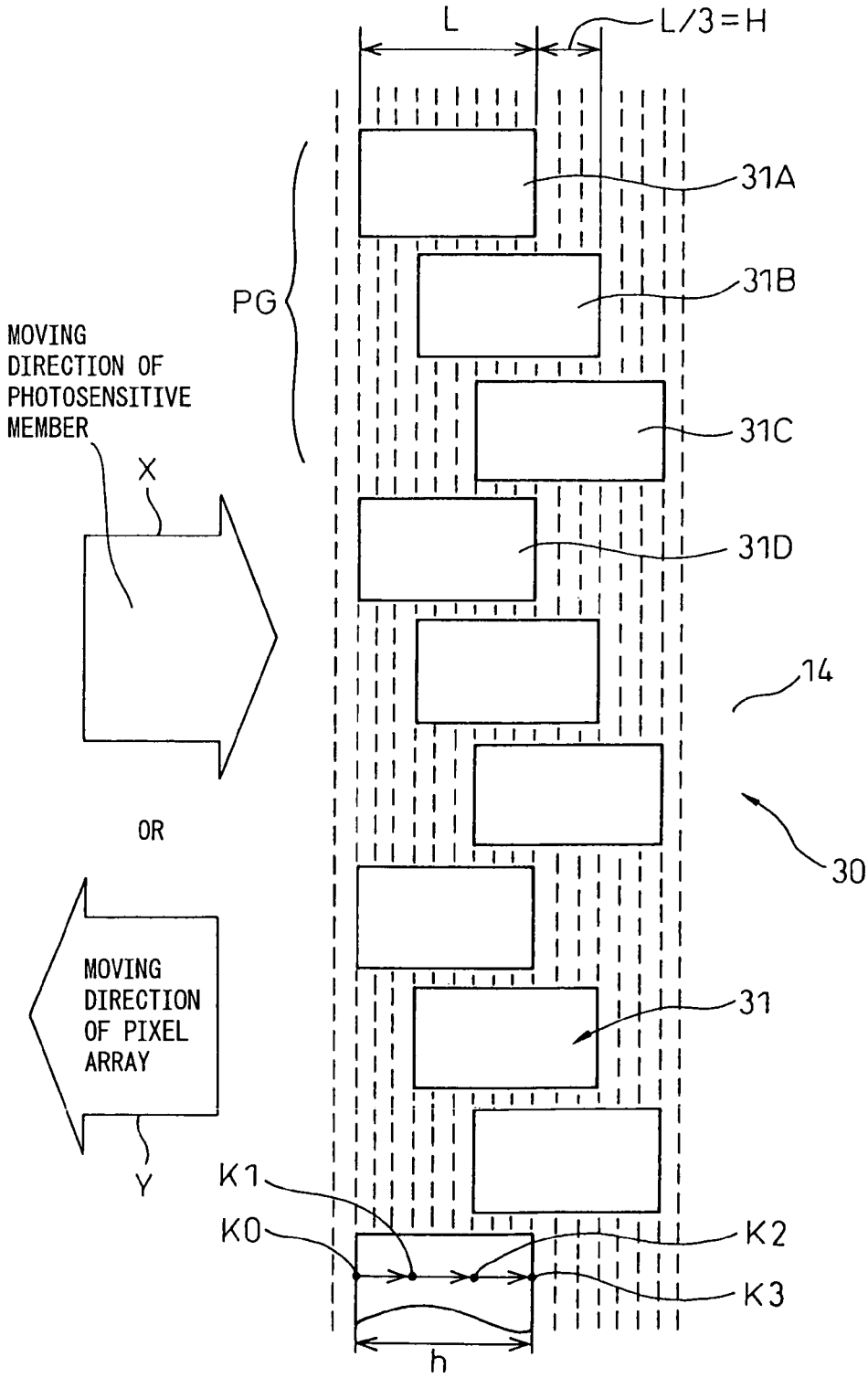
FIG. 5 is an enlarged plan view showing, partially, an arrangement of liquid crystal pixels in the liquid crystal shutter according to a first embodiment of the present invention.

FIG. 5 is a diagram showing in detail the arrangement of the liquid crystal pixels 31 in the liquid crystal pixel array 30 in the embodiment shown in FIG. 4C. As shown, the three liquid crystal pixels 31 in each pixel group PG are arranged displaced from another by L/3 where L is the overall length of each liquid crystal pixel 31 measured along the direction of the relative movement of the photosensitive member. The direction in which the liquid crystal pixels 31 are displaced is the same as the moving direction of the photosensitive member (shown by arrow X in FIG. 5), that is, the direction from the upstream to the downstream side. More specifically, in the same pixel group PG, the liquid crystal pixel 31B adjacent to the liquid crystal pixel 31A is displaced by L/3 in the downstream direction, and the liquid crystal pixel 31C adjacent to the liquid crystal pixel 31B is displaced by L/3 in the downstream direction. The position of the first liquid crystal pixel 31D in the adjacent pixel group PG is the same as the position of the liquid crystal pixel 31A. The same applies to the case in which the liquid crystal pixel array 30 is moved relative to the photosensitive member in the direction shown by arrow Y in FIG. 5.

Figure 6A:
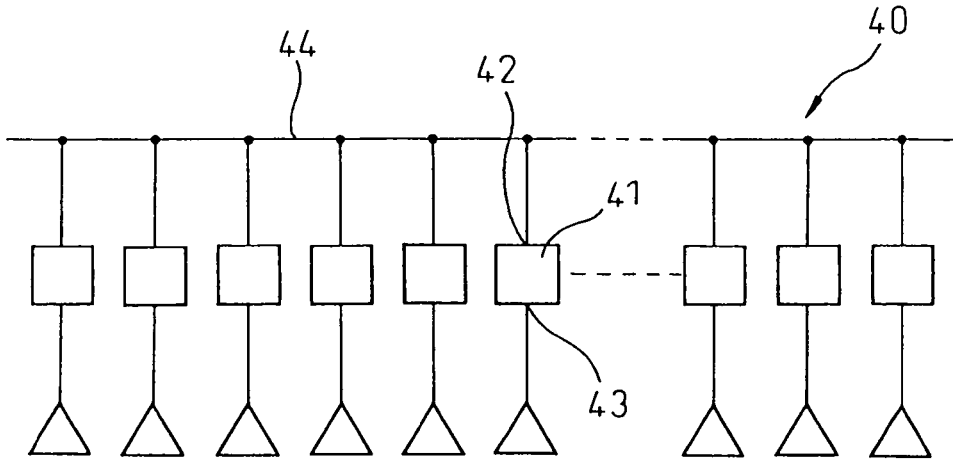
FIG. 6A is a diagram showing the configuration of a driving circuit for the liquid crystal pixel array in the prior art liquid crystal shutter shown in FIG. 4B.
Figure 6B:
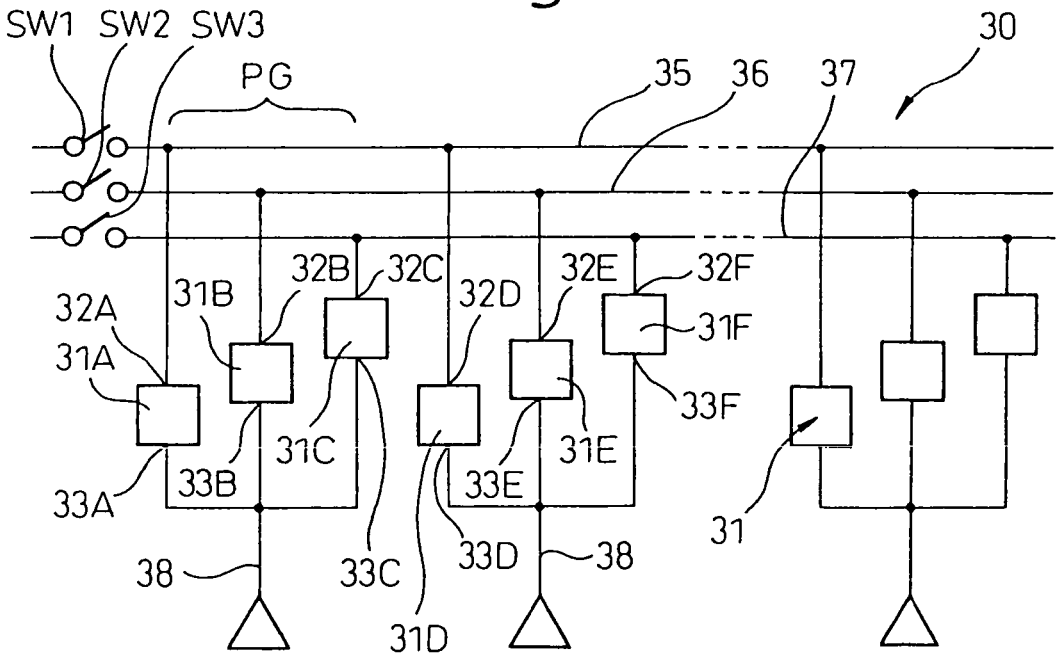
FIG. 6B is a diagram showing the configuration of a driving circuit for the liquid crystal pixel array in the liquid crystal shutter according to the present invention shown in FIG. 4C.

FIG. 6A is a diagram showing the configuration of a driving circuit for the liquid crystal pixel array 40 in the prior art liquid crystal shutter shown in FIG. 4B, and FIG. 6B is a diagram showing the configuration of a driving circuit for the liquid crystal pixel array 30 in the present embodiment shown in FIG. 4C. In the prior art liquid crystal pixel array 40, one electrode (the first electrode or common electrode) 42 of each liquid crystal cell forming one liquid crystal pixel 41 is connected in common to a fixed line 44, and the other electrode (the second electrode or data electrode) 43 is connected to a corresponding one of the driver ICs 24 shown in FIG. 4A. Here, each driver IC 24 has 160 drive pins; therefore, if the liquid crystal pixel array 40 consists of 480 pixels, then 160×3=480 pins, that is, a total of three driver ICs, will be required. This means that the driver ICs 24 as a whole need to have as many output pins as there are liquid crystal pixels 41 in the liquid crystal pixel array 40, necessitating increasing the size of each driver IC or the number of driver ICs.

On the other hand, in the liquid crystal pixel array 30 according to the present embodiment shown in FIG. 6B, the liquid crystal pixels 31 constituting the liquid crystal pixel array 30 are divided into pixel groups PG of three pixels each. When the three liquid crystal pixels 31 in each pixel group PG are denoted, for example, as the liquid crystal pixels 31A, 31B, and 31C, respectively, one electrode 32A of the liquid crystal cell forming the liquid crystal pixel 31A is connected to a first time-division line 35, and one electrode 32B of the liquid crystal cell forming the liquid crystal pixel 31B is connected to a second time-division line 36, while one electrode 32C of the liquid crystal cell forming the liquid crystal pixel 31C is connected to a third time-division line 37. The other electrodes 33A, 33B, and 33C of the liquid crystal pixels 31A, 31B, and 31C in the same pixel group PG are connected together, and then connected via a data line 38 to a corresponding one of the driver ICs 24 shown in FIG. 4A.

When the three liquid crystal pixels 31 in the adjacent pixel group PG are denoted, for example, as the liquid crystal pixels 31D, 31E, and 31F, respectively, the liquid crystal pixel 31D is connected in the same way as its corresponding liquid crystal pixel 31A, and the liquid crystal pixel 31E is connected in the same way as its corresponding liquid crystal pixel 31B, while the liquid crystal pixel 31F is connected in the same way as its corresponding liquid crystal pixel 31C. That is, the data electrodes of the liquid crystal pixels formed in mutually corresponding positions in the respective pixel groups are all connected to the same time-division line.

Here, when the first time-division line 35 is selected (the other time-division lines are unselected), the liquid crystal pixels 31 that are connected in the respective pixel groups PG to the first time-division line 35 are put in a light transmitting state. Likewise, when the second time-division line 36 is selected, the liquid crystal pixels 31 that are connected in the respective pixel groups PG to the second time-division line 36 are put in a light transmitting state. Further, when the third time-division line 37 is selected, the liquid crystal pixels 31 that are connected in the respective pixel groups PG to the third time-division line 37 are put in a light transmitting state.

Switches SW1 to SW3 shown in FIG. 6B are depicted in order to facilitate the understanding of the selected/unselected states of the first to third time-division lines 35 to 37. In the actual circuit, therefore, the switch selector circuit such as shown here is not an essential requirement, but any other suitable circuit configuration having a similar function can be employed (this also applies to second to sixth embodiments to be described later). The selected state of the first time-division line 35 corresponds to the state in which the switch SW1 is in the ON state, while the unselected state of the first time-division line 35 corresponds to the state in which the switch SW1 is in the OFF state. Actually, the first to third time-division lines 35 to 37 are electrically connected to the driving circuit at all times.

In this way, in the present embodiment, only one liquid crystal pixel in each pixel group PG is connected to the driver IC 24; therefore, when each pixel group PG consists of three liquid crystal pixels 31, the total number of driver IC output pins can be reduced to one third the total number of liquid crystal pixels 31 contained in the liquid crystal pixel array 30. Each driver IC 24 has 160 drive pins; therefore, if the liquid crystal pixel array 30 consists of 480 pixels, then 480÷3=160, that is, only one driver IC need be provided. This means that the three driver ICs 24 shown in FIGS. 3 and 4 can be replaced in the present embodiment by one driver IC, and a substantial reduction in cost can thus be achieved.

Figure 7:
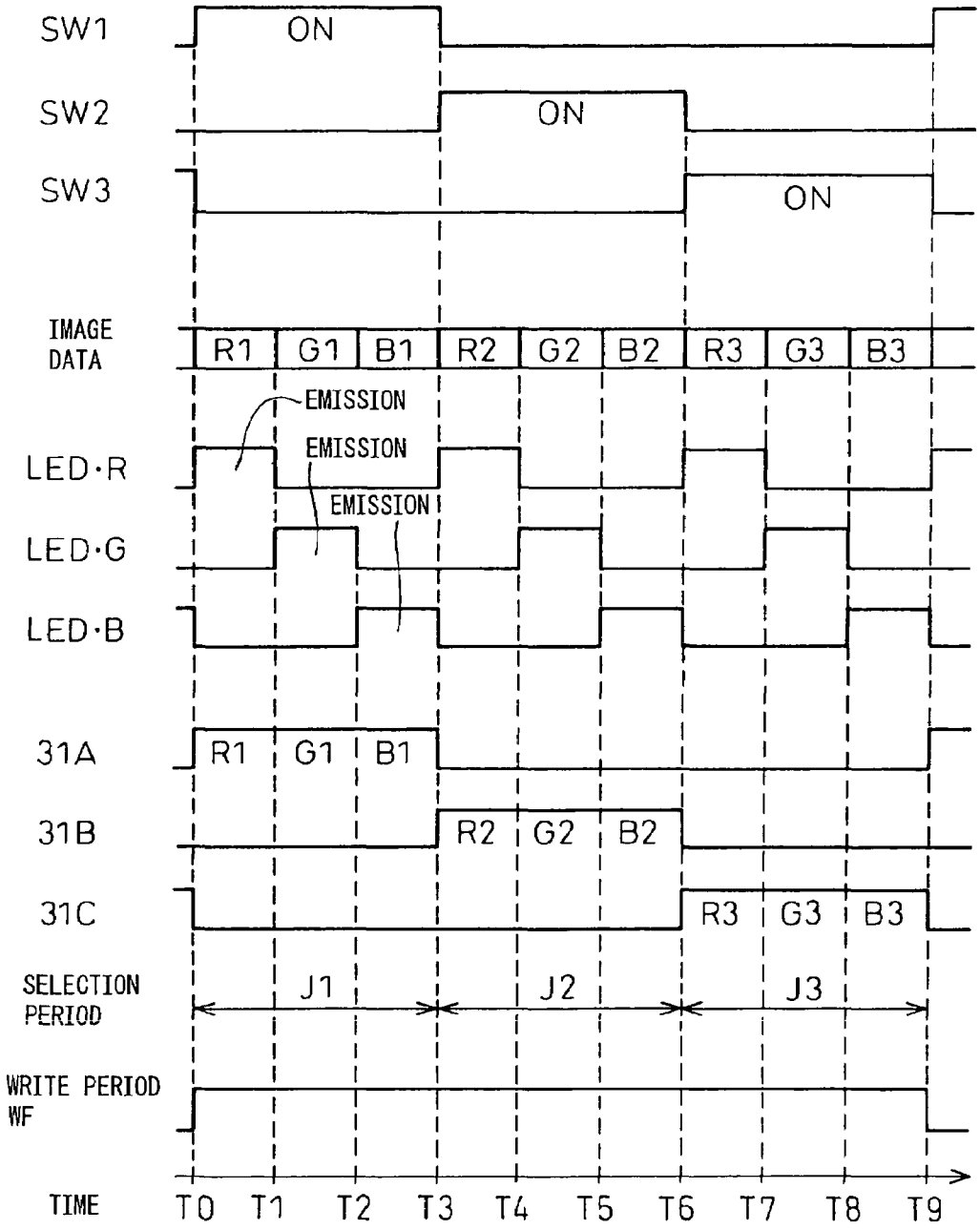
FIG. 7 is a waveform diagram showing driving waveforms for three adjacent liquid crystal pixels in the liquid crystal shutter according to the first embodiment of the present invention shown in FIG. 6B.

FIG. 7 is a waveform diagram showing driving waveforms for various parts when the driver IC drives the three adjacent liquid crystal pixels contained in one pixel group PG in the liquid crystal pixel array 30 shown in FIG. 6B. The driving waveforms only for one pixel group PG will be described here, as the driving waveforms for the liquid crystal pixels 31 in the other pixel groups PG are exactly the same as those shown here.

First, the selected/unselected states of the first, second, and third time-division lines 35, 36, and 37 shown in FIG. 6B will be described in conjunction with the operations of the switches SW1, SW2, and SW3. As earlier described, the switch ON state means that the corresponding time-division line is selected, while the OFF state means that the corresponding time-division line is unselected. At any instant in time, only one of the switches SW1 to SW3 is on, and the other switches remain off. During the period from time T0 to time T3, the switch SW1 is on. During the next period from time T3 to time T6, the switch SW2 is on, and during the subsequent period from time T6 to time T9, the switch SW3 is on. The length of the ON period is the same for each of the switches SW1 to SW3. Thereafter, the switches SW1 to SW3 repeatedly cycle between the ON and OFF states in a like manner.

In this way, the first to third time-division lines 35 to 37 are respectively selected in cyclic fashion; the period during which each time-division line is selected (for example, the period from time T0 to time T3) is called the selection period.

Next, a description will be given of image data which is applied from the driver IC to the data line 38. Actually, the image data is a data voltage applied from the driver IC to the data line 38, and this data voltage is referred to as the image data in this specification. Further, to facilitate explanation, the data voltages applied to the three liquid crystal pixels 31A, 31B, and 31C for red color exposure will be referred to as the red data R1, R2, and R3, respectively. The magnitudes of the respective data voltages, that is, the contents of the data R1, R2, and R3, will not be described here because they are not essential requirements of the present invention.

In the T0 to T3 period during which the switch SW1 is on, the image data applied is the red data R1 from time T0 to time T1, the green data G1 from time T1 to time T2, and the blue data B1 from time T2 to time T3. Likewise, in the T3 to T6 period during which the switch SW2 is on, the image data applied is the red data R2 from time T3 to time T4, the green data G2 from time T4 to time T5, and the blue data B2 from time T5 to time T6. Further, in the T6 to T9 period during which the switch SW3 is on, the image data applied is the red data R3 from time T6 to time T7, the green data G3 from time T7 to time T8, and the blue data B3 from time T8 to time T9. Thereafter, the red, green, and blue data are applied from the driver IC to the data line 38 in like manner as the switches SW1 to SW3 are turned on and off.

On the other hand, in the color light source 11 also, only one of the three color LEDs 11R, 11G, and 11B emits light at any instant in time. In the present embodiment, only the red LED 11R emits light during the T0 to T1, T3 to T4, and T6 to T7 periods in which the red data R1, R2, and R3 are respectively applied. Likewise, only the green LED 11G emits light during the T1 to T2, T4 to T5, and T7 to T8 periods in which the green data G1, G2, and G3 are respectively applied. Further, only the blue LED 11B emits light during the T2 to T3, T5 to T6, and T8 to T9 periods in which the blue data B1, B2, and B3 are respectively applied. In this way, the three color LEDs 11R, 11G, and 11B in the color light source 11 emit lights on in sequence in accordance with the respective color data to be output on the data line 38.

When the data voltage (i.e., image data) is applied with one of the switches SW1 to SW3 in the ON state, the corresponding one of the three liquid crystal pixels 31A, 31B, and 31C is put in a light transmitting state (hereinafter referred to as "opened"), allowing the colored light emitted from the corresponding LED to pass through for exposure on the photosensitive member 14.

Accordingly, the liquid crystal pixel 31A is opened in accordance with the red, green, and blue data R1, G1, and B1 applied in sequence during the T0 to T3 period in which the switch SW1 is on. That is, during the period from T0 to T1, the liquid crystal pixel 31A transmits the red light emitted from the LED 11R to expose the photosensitive member 14 to the red light in accordance with the red data R1. Then, during the period from T1 to T2, the liquid crystal pixel 31A transmits the green light emitted from the LED 11G to expose the photosensitive member 14 to the green light in accordance with the green data G1 in overlaying fashion on the red exposure. Further, during the period from T2 to T3, the liquid crystal pixel 31A transmits the blue light emitted from the LED 11B to expose the photosensitive member 14 to the blue light in accordance with the blue data B1 in overlaying fashion on the red and green exposures.

On the other hand, the liquid crystal pixel 31B is opened in accordance with the red, green, and blue data R2, G2, and B2 applied in sequence during the T3 to T6 period in which the switch SW2 is on. That is, during the period from T3 to T4, the liquid crystal pixel 31B transmits the red light emitted from the LED 11R to expose the photosensitive member 14 to the red light in accordance with the red data R2. Then, during the period from T4 to T5, the liquid crystal pixel 31B transmits the green light emitted from the LED 11G to expose the photosensitive member 14 to the green light in accordance with the green data G2 in overlaying fashion on the red exposure. Further, during the period from T5 to T6, the liquid crystal pixel 31B transmits the blue light emitted from the LED 11B to expose the photosensitive member 14 to the blue light in accordance with the blue data B2 in overlaying fashion on the red and green exposures.

Likewise, the liquid crystal pixel 31C is opened in accordance with the red, green, and blue data R3, G3, and B3 applied in sequence during the T6 to T9 period in which the switch SW3 is on. That is, during the period from T6 to T7, the liquid crystal pixel 31C transmits the red light emitted from the LED 11R to expose the photosensitive member 14 to the red light in accordance with the red data R3. Then, during the period from T7 to T8, the liquid crystal pixel 31C transmits the green light emitted from the LED 11G to expose the photosensitive member 14 to the green light in accordance with the green data G3 in overlaying fashion on the red exposure. Further, during the period from T8 to T9, the liquid crystal pixel 31C transmits the blue light emitted from the LED 11B to expose the photosensitive member 14 to the blue light in accordance with the blue data B3 in overlaying fashion on the red and green exposures.

In this way, in the present embodiment, each of the three liquid crystal pixels in each pixel group PG exposes the photosensitive member 14 to the red, green, and blue lights in sequence with a prescribed cycle. When the exposure with the image data for one liquid crystal pixel is completed, the next adjacent liquid crystal pixel exposes the photosensitive member 14 to the red, green, and blue lights in sequence with the same cycle. The same operation is further repeated. Here, the cycle with which each liquid crystal pixel in each pixel group PG performs exposures in accordance with the data of the respective colors will be referred to as the "selection period". In this specification, the selection period during which the first liquid crystal pixel performs exposures with the red, green, and blue colors is denoted by J1, the selection period during which the second liquid crystal pixel performs exposures with the respective colors is denoted by J2, and the selection period during which the third liquid crystal pixel performs exposures with the respective colors is denoted by J3. As shown in FIG. 7, the period corresponding to the sum of the three selection periods J1, J2, and J3 is the write period WF during which one pixel group PG writes image data for one line.

Figure 8A:
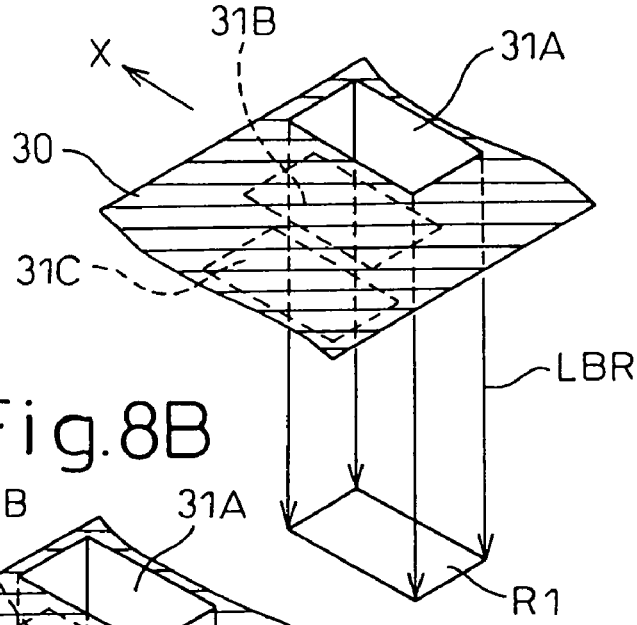
FIG. 8A is an explanatory diagram showing the operation of the liquid crystal shutter during the period from time T0 to time T1 in FIG. 7 and the data written during the same period.
Figure 8B:
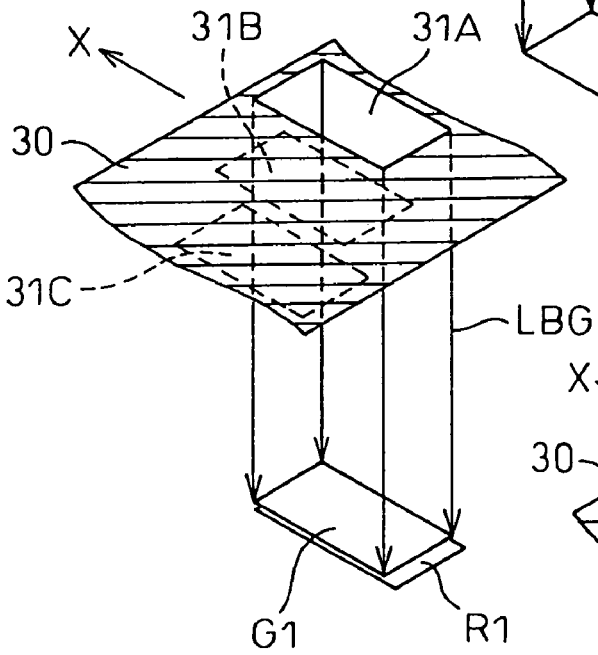
FIG. 8B is an explanatory diagram showing the operation of the liquid crystal shutter during the period from time T1 to time T2 in FIG. 7 and the data written during the same period.
Figure 8C:
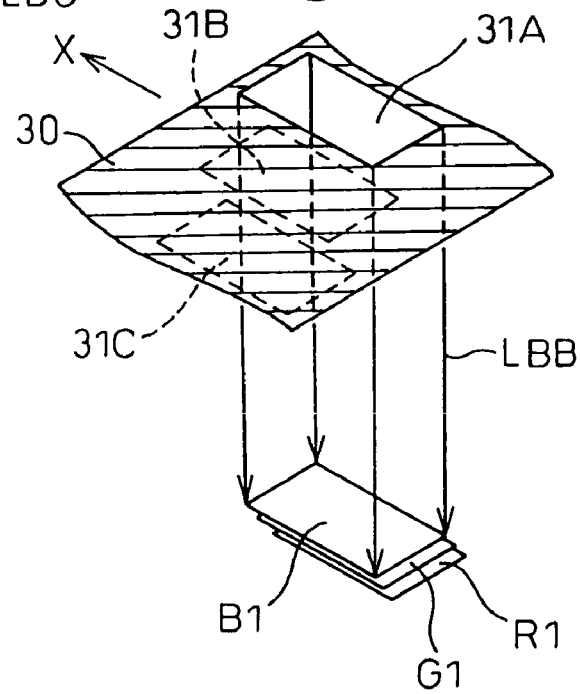
FIG. 8C is an explanatory diagram showing the operation of the liquid crystal shutter during the period from time T2 to time T3 in FIG. 7 and the data written during the same period.

FIGS. 8A to 8C are diagrams showing how the first liquid crystal pixel 31A of the three liquid crystal pixels in one pixel group PG performs exposures with the red, green, and blue image data during the selection period J1, and how the image data are applied for exposure of the photosensitive member 14 during the same period. It is assumed here that the liquid crystal pixel array 30 is moved relative to the photosensitive member 14 in the direction of arrow X, and the hatched area indicates the light blocking area.

FIG. 8A is a diagram showing the operation of the liquid crystal pixels 31A, 31B, and 31C during the period from T0 to T1 in FIG. 7 and the data written during the same period. During this period, the liquid crystal pixel 31A is open, so that the red light LBR from the LED 11R is passed through the liquid crystal pixel 31A as shown by arrows, to expose the photosensitive member 14 in accordance with the red data R1. FIG. 8A shows the state at time T0.

FIG. 8B is a diagram showing the operation of the liquid crystal pixels 31A, 31B, and 31C during the period from T1 to T2 in FIG. 7 and the data written during the same period. During this period also, the liquid crystal pixel 31A is open, so that the green light LBG from the LED 11G is passed through the liquid crystal pixel 31A as shown by arrows, to expose the photosensitive member 14 in accordance with the green data G1. Exposure with the image data G1 is performed in such a manner as to be overlaid on the area already exposed with the image data R1 but in a position slightly displaced from it. FIG. 8B shows the state at time T1. Here, as the liquid crystal pixel array 30 is constantly moving in the direction of arrow X during the exposure, the area exposed with the image data R1 may become larger than the area of the liquid crystal pixel 31A.

FIG. 8C is an explanatory diagram showing the operation of the liquid crystal pixels 31A, 31B, and 31C during the period from T2 to T3 in FIG. 7 and the data written during the same period. During this period also, the liquid crystal pixel 31A is open, so that the blue light LBB from the LED 11B is passed through the liquid crystal pixel 31A as shown by arrows, to expose the photosensitive member 14 in accordance with the blue data B1. Exposure with the blue data B1 is performed in such a manner as to be overlaid on the areas already exposed with the image data R1 and G1 but in a position slightly displaced from the image data G1. FIG. 8C shows the state at time T2.

Figure 9A:
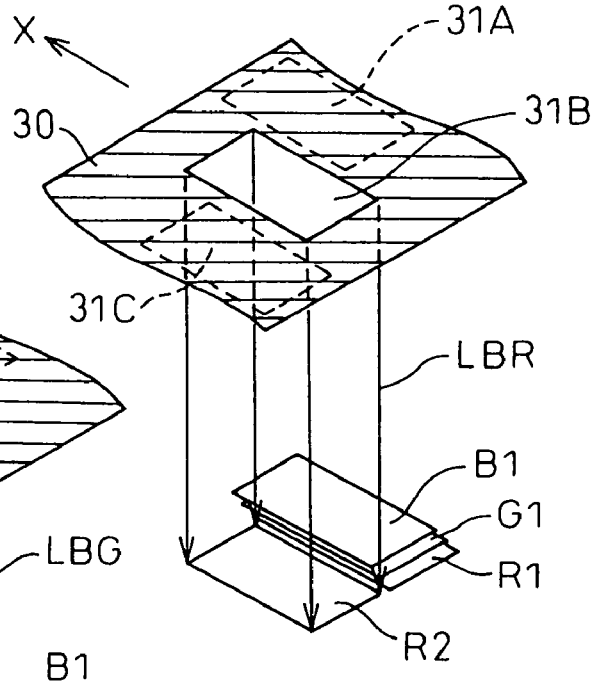
FIG. 9A is an explanatory diagram showing the operation of the liquid crystal shutter the during period from time T3 to time T4 in FIG. 7 and the data written during the same period.
Figure 9B:
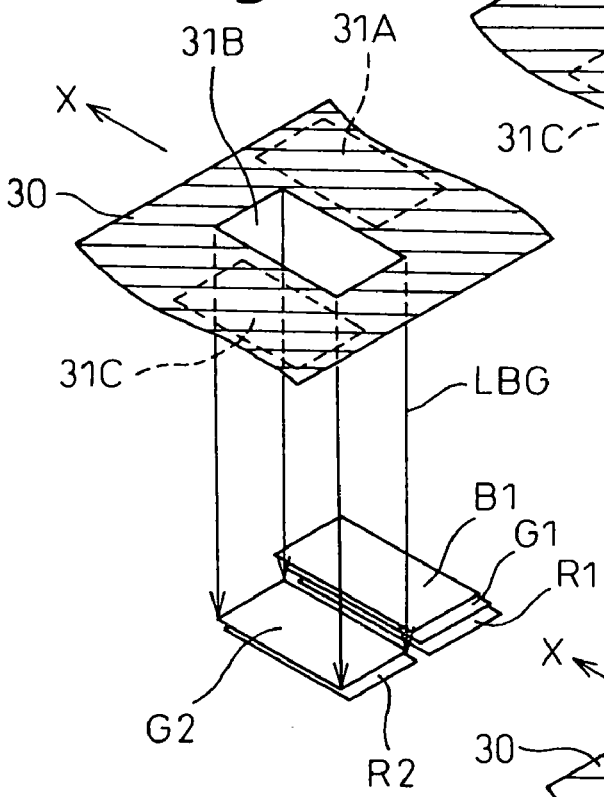
FIG. 9B is an explanatory diagram showing the operation of the liquid crystal shutter during period from time T4 to time T5 in FIG. 7 and the data written during the same period.
Figure 9C:
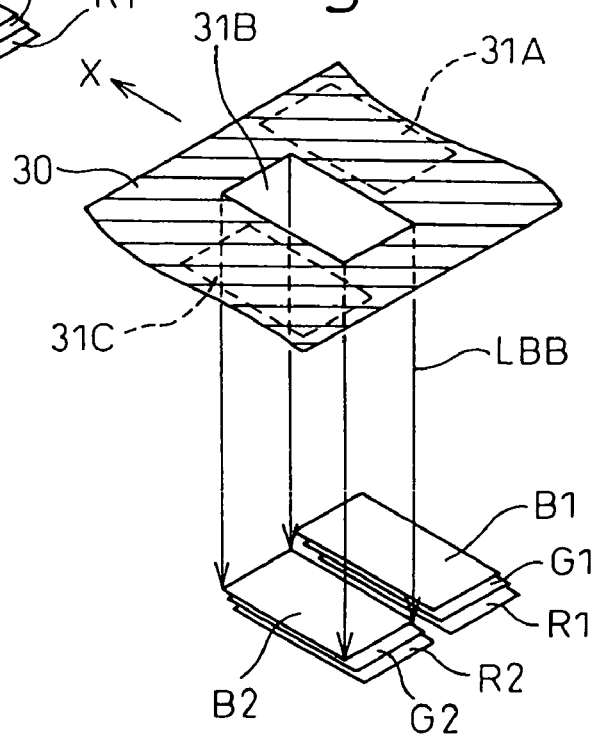
FIG. 9C is an explanatory diagram showing the operation of the liquid crystal shutter during period from time T5 to time T6 in FIG. 7 and the data written during the same period.

FIGS. 9A to 9C are diagrams showing how the second liquid crystal pixel 31B of the three liquid crystal pixels in one pixel group PG performs exposures with the red, green, and blue image data during the selection period J2, and how the image data are applied for exposure of the photosensitive member 14 during the same period. Here also, it is assumed that the liquid crystal pixel array 30 is moved relative to the photosensitive member 14 in the direction of arrow X, and the hatched area indicates the light blocking area.

FIG. 9A is a diagram showing the operation of the liquid crystal pixels 31A, 31B, and 31C during the period from T3 to T4 in FIG. 7 and the data written during the same period. During this period, the liquid crystal pixel 31B is open, so that the red light LBR from the LED 11R is passed through the liquid crystal pixel 31B as shown by arrows, to expose the photosensitive member 14 in accordance with the red data R2. As the moving distance of the liquid crystal pixel array 30 from time T0 to T3 is equal to the amount of displacement (L/3) between the liquid crystal pixels 31A and 31B, the exposure start position of the image data R2 is the same as the exposure start position of the image data R1 when viewed along the direction orthogonal to the moving direction of the liquid crystal pixel array 30.

FIG. 9B is a diagram showing the operation of the liquid crystal pixels 31A, 31B, and 31C during the period from T4 to T6 in FIG. 7 and the data written during the same period.

During this period also, the liquid crystal pixel 31B is open, so that the green light LBG from the LED 11G is passed through the liquid crystal pixel 31B as shown by arrows, to expose the photosensitive member 14 in accordance with the green data G2. Exposure with the image data G2 is performed in such a manner as to be overlaid on the area already exposed with the image data R2 but in a position slightly displaced from it. FIG. 9B shows the state at time T4. Here, as the liquid crystal pixel array 30 is constantly moving in the direction of arrow X during the exposure, the area exposed with the image data R2 may become larger than the area of the liquid crystal pixel 31B. The exposure start position of the image data G2 is the same as the exposure start position of the image data G1 when viewed along the direction orthogonal to the moving direction of the liquid crystal pixel array 30.

FIG. 9C is an explanatory diagram showing the operation of the liquid crystal pixels 31A, 31B, and 31C during the period from T5 to T6 in FIG. 7 and the data written during the same period. During this period also, the liquid crystal pixel 31B is open, so that the blue light LBB from the LED 11B is passed through the liquid crystal pixel 31B as shown by arrows, to expose the photosensitive member 14 in accordance with the blue data B2. Exposure with the blue data B2 is performed in such a manner as to be overlaid on the areas already exposed with the image data R2 and G2 but in a position slightly displaced from the image data G2. FIG. 9C shows the state at time T5. The exposure start position of the image data B2 is the same as the exposure start position of the image data B1 when viewed along the direction orthogonal to the moving direction of the liquid crystal pixel array 30.

Figure 10A:
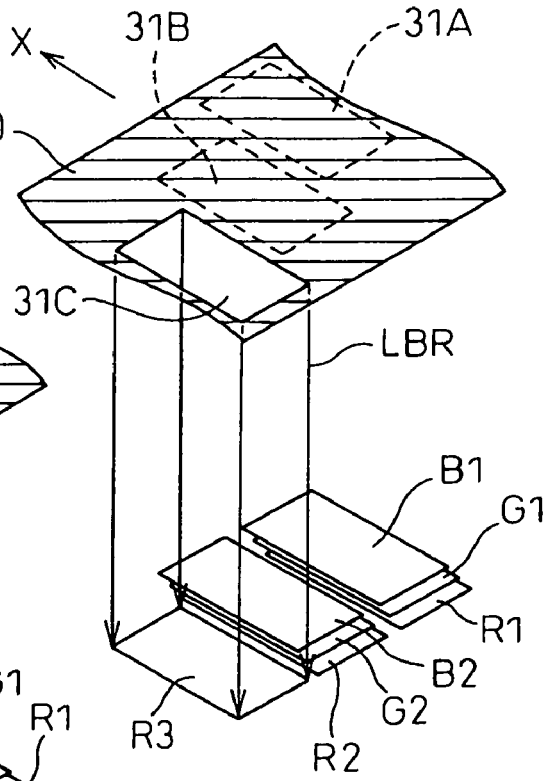
FIG. 10A is an explanatory diagram showing the operation of the liquid crystal shutter during period from time T6 to time T7 in FIG. 7 and the data written during the same period.
Figure 10B:
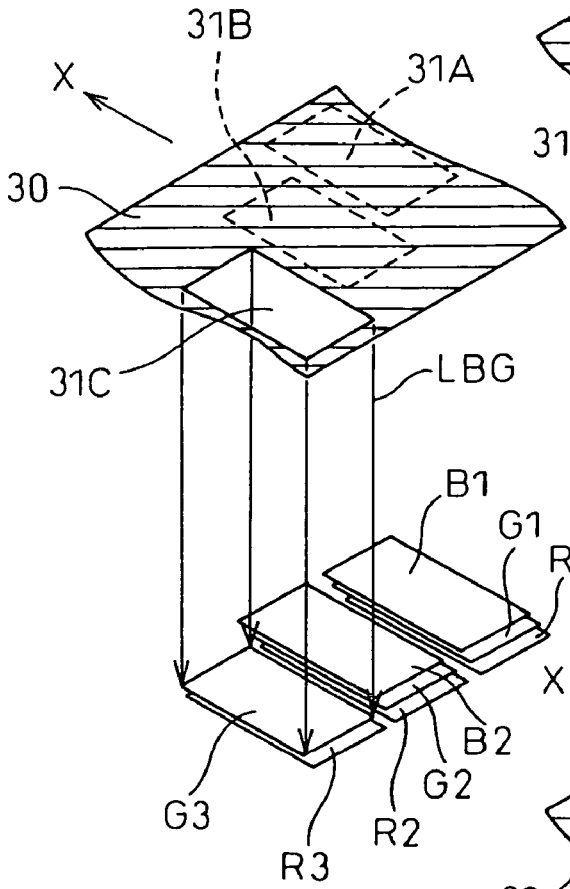
FIG. 10B is an explanatory diagram showing the operation of the liquid crystal shutter during period from time T7 to time T8 in FIG. 7 and the data written during the same period.
Figure 10C:
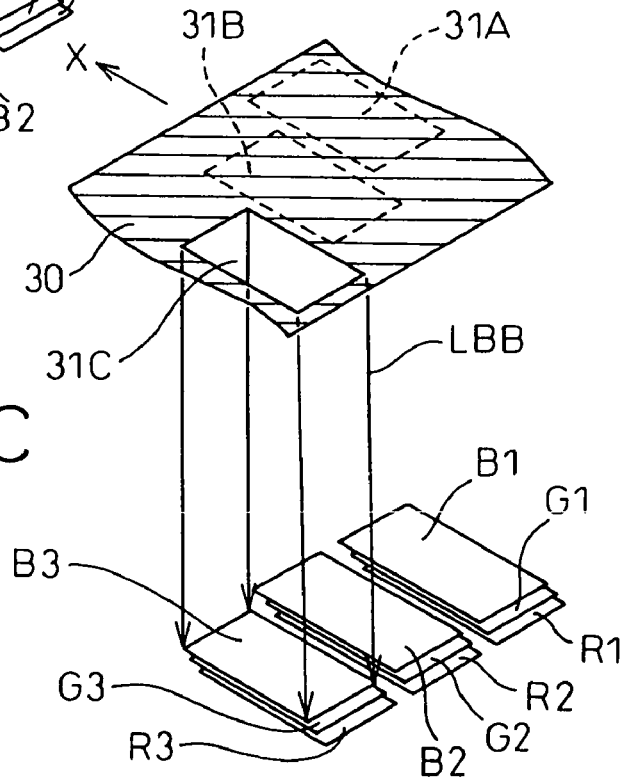
FIG. 10C is an explanatory diagram showing the operation of the liquid crystal shutter during period from time T8 to time T9 in FIG. 7 and the data written during the same period.

FIGS. 10A to 10C are diagrams showing how the third liquid crystal pixel 31C of the three liquid crystal pixels in one pixel group PG performs exposures with the red, green, and blue image data during the selection period J3, and how the image data are applied for exposure of the photosensitive member 14 during the same period. Here also, it is assumed that the liquid crystal pixel array 30 is moved relative to the photosensitive member 14 in the direction of arrow X, and the hatched area indicates the light blocking area.

FIG. 10A is a diagram showing the operation of the liquid crystal pixels 31A, 31B, and 31C during the period from T6 to T7 in FIG. 7 and the data written during the same period. During this period, the liquid crystal pixel 31C is open, so that the red light LBR from the LED 11R is passed through the liquid crystal pixel 31C as shown by arrows, to expose the photosensitive member 14 in accordance with the red data R3. As the moving distance of the liquid crystal pixel array 30 from time T3 to time T6 is equal to the amount of displacement between the liquid crystal pixels 31B and 31C, the exposure start position of the image data R3 is the same as the exposure start position of the image data R2 when viewed along the direction orthogonal to the moving direction of the liquid crystal pixel array 30.

FIG. 10B is a diagram showing the operation of the liquid crystal pixels 31A, 31B, and 31C during the period from T7 to T8 in FIG. 7 and the data written during the same period. During this period also, the liquid crystal pixel 31C is open, so that the green light LBG from the LED 11G is passed through the liquid crystal pixel 31C as shown by arrows, to expose the photosensitive member 14 in accordance with the green data G3. Exposure with the image data G3 is performed in such a manner as to be overlaid on the area already exposed with the image data R3 but in a position slightly displaced from it. FIG. 10B shows the state at time T7. Here, as the liquid crystal pixel array 30 is constantly moving in the direction of arrow X during the exposure, the area exposed with the image data R3 may become larger than the area of the liquid crystal pixel 31C. The exposure start position of the image data G3 is the same as the exposure start position of the image data G2 when viewed along the direction orthogonal to the moving direction of the liquid crystal pixel array 30.

FIG. 10C is an explanatory diagram showing the operation of the liquid crystal pixels 31A, 31B, and 31C during the period from T8 to T9 in FIG. 7 and the data written during the same period. During this period also, the liquid crystal pixel 31C is open, so that the blue light LBB from the LED 11B is passed through the liquid crystal pixel 31C as shown by arrows, to expose the photosensitive member 14 in accordance with the blue data B3. Exposure with the blue data B3 is performed in such a manner as to be overlaid on the areas already exposed with the image data R3 and G3 but in a position slightly displaced from the image data G3. FIG. 10C shows the state at time T8, and the exposure start position of the image data B3 is the same as the exposure start position of the image data B2 when viewed along the direction orthogonal to the moving direction of the liquid crystal pixel array 30.

Here, the reason that the exposure with the data of the same color always starts at the same position when viewed along the direction orthogonal to the moving direction X of the liquid crystal pixel array 30 is because the relation $H=h/N=h/3$ holds, where h is the distance over which the photosensitive member 14 relatively moves during the write period WF, N is the number of liquid crystal pixels in each pixel group (N=3 in the present embodiment), and H is the distance by which the liquid crystal pixels are displaced relative to each other.

Further, in the present embodiment, the length L of each liquid crystal pixel 31 in the liquid crystal pixel array 30, measured along the direction of the relative movement, is set equal to h. While it is desirable that the length L of each liquid crystal pixel 31 in the liquid crystal pixel array 30, measured along the direction of the relative movement, be set equal to the distance h, the length L may not necessarily be made equal to the distance h.

Here, the relations between the write period WF, the distance h over which the photosensitive member 14 relatively moves during the write period WF, the number N of liquid crystal pixels in each pixel group (N=3 in the present embodiment), the distance H by which the liquid crystal pixels are displaced relative to each other, and the length L of each liquid crystal pixel 31 measured along the direction of the relative movement, will be explained with reference to FIG. 5.

For example, note the point K0 on the photosensitive member 14 located directly below the leading edge of a given liquid crystal pixel 31. As the distance h over which the photosensitive member 14 relatively moves during the write period WF is equal to the length L of the liquid crystal pixel 31 measured along the direction of the relative movement, at the end of the selection period J1, the point K0 has moved to the position of point K1 downstream by the distance H (=L/3) by which the liquid crystal pixels are displaced relative to each other. At the end of the selection periods J1+J2, the point K0 has moved to the position of point K2 further downstream by the distance H. Further, at the end of the selection periods J1+J2+J3 (that is, at the end of the write period WF), the point K0 has moved to the position of point K3 which is located away from the initial position by a distance equal to the length L of the liquid crystal pixel 31 measured along the direction of the relative movement.

The above has described the exposure operation performed on the photosensitive member 14 during the write period WF shown in FIG. 7, and this operation is repeated after that. That is, in the present embodiment, as the number of liquid crystal pixels in each pixel group PG is 3, the write period WF required to complete the color exposures on the photosensitive member 14 is the sum of the selection periods (J1=J2=J3) during which the time-division lines 35 to 37 are respectively driven, the write period WF thus being equal to three times the selection period.

(2) Embodiment 2

Next, a second embodiment of the present invention will be described; in this embodiment, the liquid crystal pixels 31 constituting the liquid crystal pixel array 30 are divided into pixel groups PG of two pixels each, and the two liquid crystal pixels 31 in each pixel group PG are arranged one displaced from the other by L/2 (L is the length of each liquid crystal pixel 31 measured along the direction of the relative movement of the photosensitive member).

In this embodiment, the position of the liquid crystal shutter array 20 in the accommodating recess 26 is adjusted by means of the adjusting screws 29 so that the line passing through the center of the block of the two liquid crystal pixels in each pixel group PG coincides with the center line CL of the opening 19.

Figure 11A:
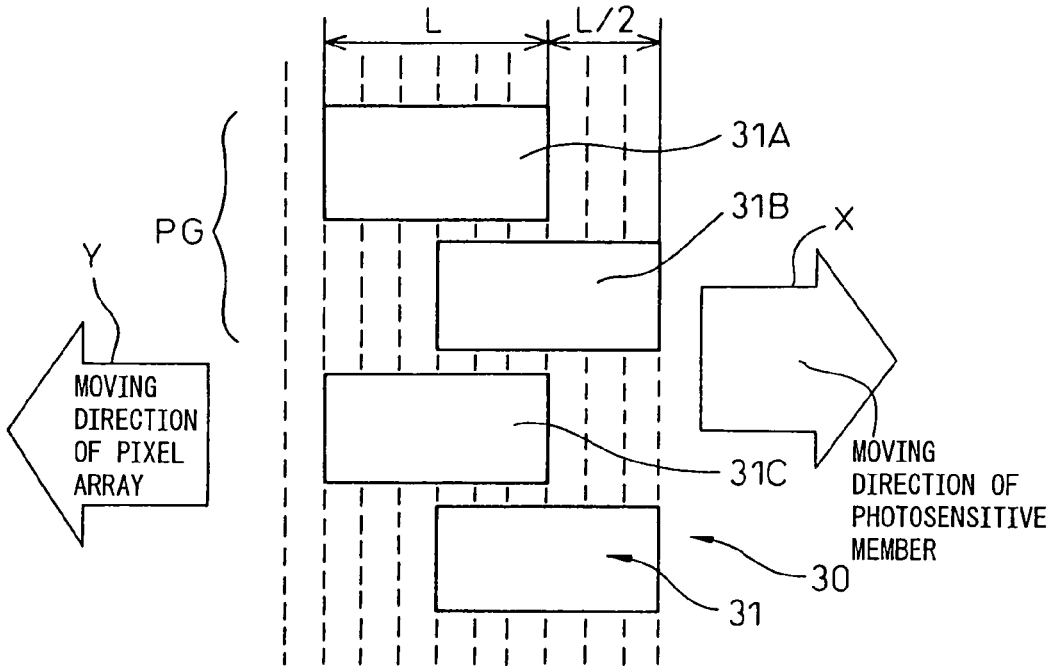
FIG. 11A is an enlarged plan view showing, partially, an arrangement of liquid crystal pixels in the liquid crystal shutter according to a second embodiment of the present invention.

FIG. 11A is an enlarged view showing the configuration of the liquid crystal pixel array 30 in the liquid crystal shutter according to the second embodiment. In this embodiment, the liquid crystal pixels 31 constituting the liquid crystal pixel array 30 are divided into pixel groups PG of two pixels each. As shown, the two liquid crystal pixels 31 in each pixel group PG are arranged one displaced from the other by L/2, where L is the overall length of each liquid crystal pixel 31 measured along the direction of the relative movement of the photosensitive member. The direction in which the liquid crystal pixels 31 are displaced is the same as the moving direction of the photosensitive member (shown by arrow X in FIG. 11A), that is, the direction from the upstream to the downstream side. More specifically, in the same pixel group PG, the liquid crystal pixel 31B adjacent to the liquid crystal pixel 31A is displaced by L/2 in the downstream direction. The position of the first liquid crystal pixel 31C in the adjacent pixel group PG is the same as the position of the liquid crystal pixel 31A. The same applies to the case in which the liquid crystal pixel array 30 is moved relative to the photosensitive member in the direction shown by arrow Y in FIG. 11A.

Figure 11B:
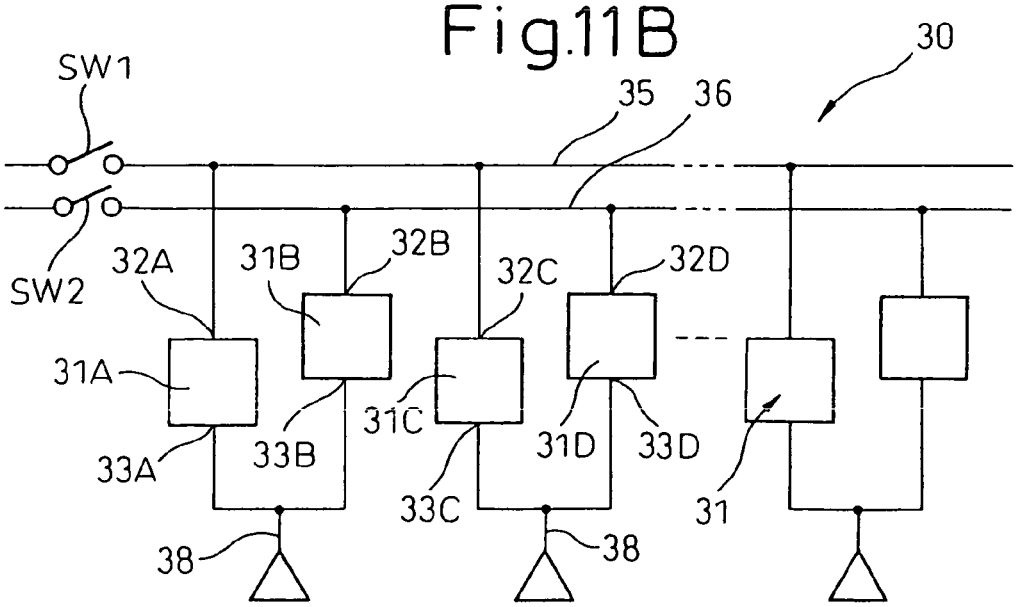
FIG. 11B is a diagram showing the configuration of a driving circuit for the liquid crystal shutter shown in FIG. 11A.

FIG. 11B is a diagram showing the configuration of a driving circuit for the liquid crystal pixel array 30 in the present embodiment. In the present embodiment, the liquid crystal pixels 31 constituting the liquid crystal pixel array 30 are divided into pixel groups PG of two pixels each. When the two liquid crystal pixels 31 in each pixel group PG are denoted, for example, as the liquid crystal pixels 31A and 31B, respectively, one electrode 32A of the liquid crystal cell forming the liquid crystal pixel 31A is connected to a first time-division line 35, and one electrode 32B of the liquid crystal cell forming the liquid crystal pixel 31B is connected to a second time-division line 36. The other electrodes 33A and 33B of the liquid crystal pixels 31A and 31B in the same pixel group PG are connected together, and then connected via a data line 38 to a corresponding one of the driver ICs 24 shown in FIG. 4.

When the two liquid crystal pixels 31 in the adjacent pixel group PG are denoted, for example, as the liquid crystal pixels 31C and 31D, respectively, the liquid crystal pixel 31C is connected in the same way as its corresponding liquid crystal pixel 31A, and the liquid crystal pixel 31D is connected in the same way as its corresponding liquid crystal pixel 31B. Here, when the switch SW1 provided in the first time-division line 35 is on (the first time-division line 35 is selected), the liquid crystal pixels 31 that are connected in the respective pixel groups PG to the first time-division line 35 are put in a light transmitting state. Likewise, when the switch SW2 provided in the second time-division line 36 is on (the second time-division line 36 is selected), the liquid crystal pixels 31 that are connected in the respective pixel groups PG to the second time-division line 36 are put in a light transmitting state.

In this way, in the present embodiment, only one electrode in each pixel group PG is connected to the driver IC 24; therefore, when each pixel group PG consists of two liquid crystal pixels 31, the total number of driver IC output pins can be reduced to one half the total number of liquid crystal pixels 31 contained in the liquid crystal pixel array 30. Here, each driver IC 24 has 160 drive pins; therefore, if the liquid crystal pixel array 30 consists of 480 pixels, then 480÷2=240, that is, only two driver ICs need be provided. This means that the three driver ICs 24 shown in FIGS. 3 and 4 can be replaced in the present embodiment by two driver ICs, and a substantial reduction in cost can thus be achieved.

Figure 12:
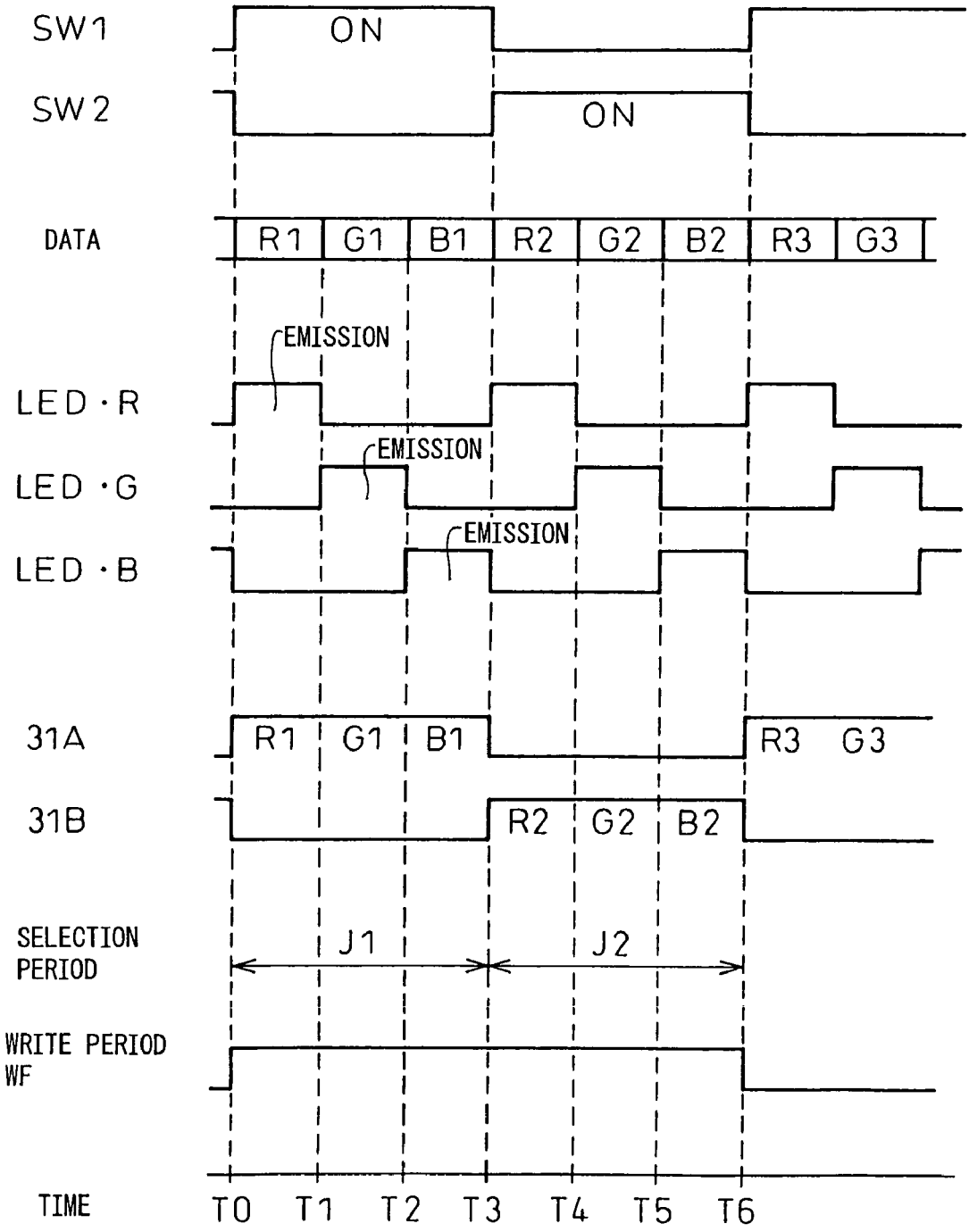
FIG. 12 is a waveform diagram showing driving waveforms for three adjacent liquid crystal pixels in the liquid crystal shutter according to the second embodiment of the present invention shown in FIG. 11.

FIG. 12 is a waveform diagram showing driving waveforms for various parts when the driver IC drives the two adjacent liquid crystal pixels contained in one pixel group PG in the liquid crystal pixel array 30 shown in FIG. 11. The driving waveforms only for one pixel group PG will be described here because the driving waveforms for the liquid crystal pixels 31 in the other pixel groups PG are exactly the same as those shown here.

The selected/unselected states of the first and second time-division lines 35 and 36 shown in FIG. 11B will be described in conjunction with the operations of the switches SW1 and SW2 provided in the respective lines. At any instant in time, only either one of the switches SW1 or SW2 is on, and the other switch remains off. During the period from time T0 to time T3, the switch SW1 is on. During the next period from time T3 to time T6, the switch SW2 is on. The length of the ON period is the same for both the switches SW1 and SW2. When the ON period of the switch SW2 ends at time T6, the switch SW1 again turns on at time T6. Thereafter, the switches SW1 and SW2 repeatedly cycle between the ON and OFF states in a like manner.

Next, a description will be given of the image data applied from the driver IC to the data line 38. In the T0 to T3 period during which the switch SW1 is on, the image data applied is the red data R1 from time T0 to time T1, the green data G1 from time T1 to time T2, and the blue data B1 from time T2 to time T3. Likewise, in the T3 to T6 period during which the switch SW2 is on, the image data applied is the red data R2 from time T3 to time T4, the green data G2 from time T4 to time T5, and the blue data B2 from time T5 to time T6.

On the other hand, in the color light source 11 also, only one of the three color LEDs 11R, 11G, and 11B emits light at any instant in time. In the second embodiment, the red LED 11R emits light during the T0 to T1 and T3 to T4 periods in which the red data R1 and R2 are respectively applied; the green LED 11G emits light during the T1 to T2 and T4 to T5 periods in which the green data G1 and G2 are respectively applied; and the blue LED 11B emits light during the T2 to T3 and T5 to T6 periods in which the blue data B1 and B2 are respectively applied. In this way, the three color LEDs 11R, 11G, and 11B in the color light source 11 emit light in sequence in accordance with the respective color data to be output on the data line 38.

When the data voltage (i.e., image data) is applied with either one of the switches SW1 or SW2 in the ON state, the corresponding one of the two liquid crystal pixels 31A and 31B is opened, allowing the colored light emitted from the corresponding LED to pass through for exposure on the photosensitive member 14.

Accordingly, the liquid crystal pixel 31A is opened in accordance with the red, green, and blue data R1, G1, and B1 applied in sequence during the T0 to T3 period in which the switch SW1 is on. That is, during the period from T0 to T1, the liquid crystal pixel 31A transmits the red light emitted from the LED 11R to expose the photosensitive member 14 in accordance with the red data R1; during the period from T1 to T2, the liquid crystal pixel 31A transmits the green light emitted from the LED 11G to expose the photosensitive member 14 in accordance with the green data G1 in overlaying fashion on the red exposure; and during the period from T2 to T3, the liquid crystal pixel 31A transmits the blue light emitted from the LED 11B to expose the photosensitive member 14 in accordance with the blue data B1 in overlaying fashion on the red and green exposures.

On the other hand, the liquid crystal pixel 31B is opened in accordance with the red, green, and blue data R2, G2, and B2 applied in sequence during the T3 to T6 period in which the switch SW2 is on. That is, during the period from T3 to T4, the liquid crystal pixel 31B transmits the red light emitted from the LED 11R to expose the photosensitive member 14 in accordance with the red data R2; during the period from T4 to T5, the liquid crystal pixel 31B transmits the green light emitted from the LED 11G to expose the photosensitive member 14 in accordance with the green data G2 in overlaying fashion on the red exposure; and during the period from T5 to T6, the liquid crystal pixel 31B transmits the blue light emitted from the LED 11B to expose the photosensitive member 14 in accordance with the blue data B2 in an overlaying fashion on the red and green exposures.

In this way, in the second embodiment, each of the two liquid crystal pixels in each pixel group PG exposes the photosensitive member 14 to the red, green, and blue light in sequence with a prescribed cycle. That is, one of the liquid crystal pixels first exposes the photosensitive member 14 in accordance with the red data and, when the exposure with the red data is completed, exposure with the green data is performed in an overlaying fashion, following which exposure with the blue data is performed in an overlaying fashion; the same operation is repeated.

The above has described the exposure operation performed on the photosensitive member 14 during the write period WF, and this operation is repeated after that. That is, in the present embodiment, as the number of liquid crystal pixels in each pixel group PG is 2, the write period WF required to complete the color exposures on the photosensitive member 14 is determined by the sum of the selection periods (J1=J2) during which the time-division lines 35 and 36 are respectively driven, the write period WF thus being equal to twice the selection period.

In the second embodiment also, the reason that the exposure with the data for the same color always starts at the same position when viewed along the direction orthogonal to the moving direction X of the liquid crystal pixel array 30 is because the relation H=h/N=h/2 holds, where h is the distance over which the photosensitive member 14 relatively moves during the write period WF, N is the number of liquid crystal pixels in each pixel group (N=2 in the present embodiment), and H is the distance by which the liquid crystal pixels are displaced relative to each other.

Further, in the present embodiment, the length L of each liquid crystal pixel 31 in the liquid crystal pixel array 30, measured along the direction of the relative movement, is set equal to h. While it is desirable that the length L of each liquid crystal pixel 31 in the liquid crystal pixel array 30, measured along the direction of the relative movement, be set equal to the distance h, the length L may not necessarily be made equal to the distance h.

(3) Embodiment 3

Next, a third embodiment of the present invention will be described; in this embodiment, the liquid crystal pixels 31 constituting the liquid crystal pixel array 30 are divided into pixel groups PG of four pixels each, and the four liquid crystal pixels 31 in each pixel group PG are arranged one displaced from another by L/4 (L is the length of each liquid crystal pixel 31 measured along the direction of the relative movement of the photosensitive member).

Figure 13A:
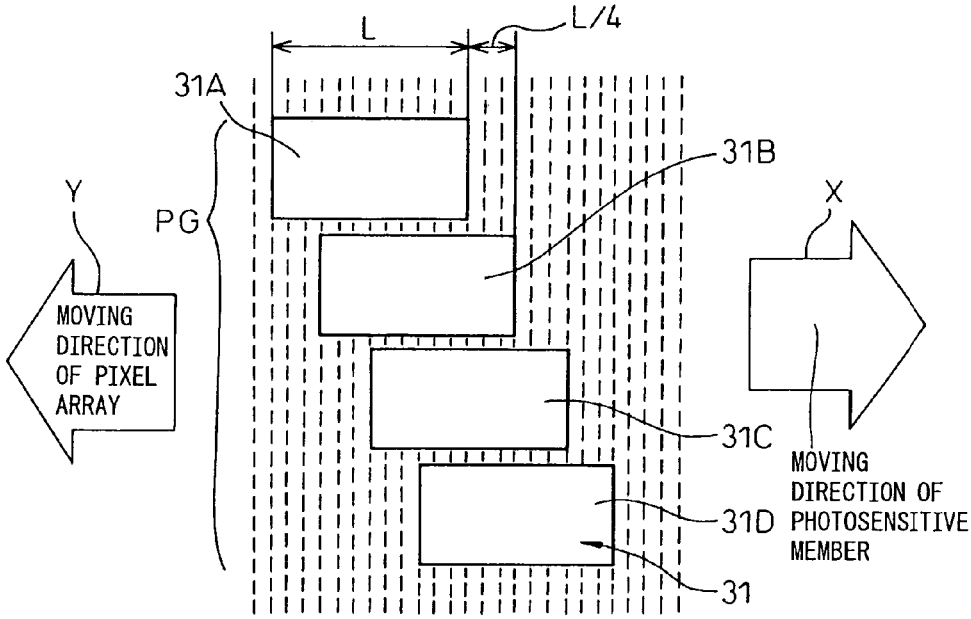
FIG. 13A is an enlarged plan view showing partially an arrangement of liquid crystal pixels in the liquid crystal shutter according to a third embodiment of the present invention.

FIG. 13A is an enlarged view showing the configuration of the liquid crystal pixel array 30 in the liquid crystal shutter according to the third embodiment. In this embodiment, the liquid crystal pixels 31 constituting the liquid crystal pixel array 30 are divided into pixel groups PG of four pixels each. As shown, the four liquid crystal pixels 31 in each pixel group PG are arranged one displaced from another by L/4, where L is the overall length of each liquid crystal pixel 31 measured along the direction of the relative movement of the photosensitive member. The direction in which the liquid crystal pixels 31 are displaced is the same as the moving direction of the photosensitive member (shown by arrow X in FIG. 13A), that is, the direction from the upstream to the downstream side when the moving direction is viewed as a stream flowing direction. More specifically, in the same pixel group PG, the liquid crystal pixel 31B adjacent to the liquid crystal pixel 31A is displaced by L/4 in the downstream direction; likewise, the liquid crystal pixels 31C and 31D are displaced by L/4 relative to the liquid crystal pixels 31B and 31C, respectively. The position of the first liquid crystal pixel (not shown) in the adjacent pixel group PG is the same as the position of the liquid crystal pixel 31A. The same applies to the case in which the liquid crystal pixel array 30 is moved relative to the photosensitive member in the direction shown by arrow Y in FIG. 13A.

Figure 13B:
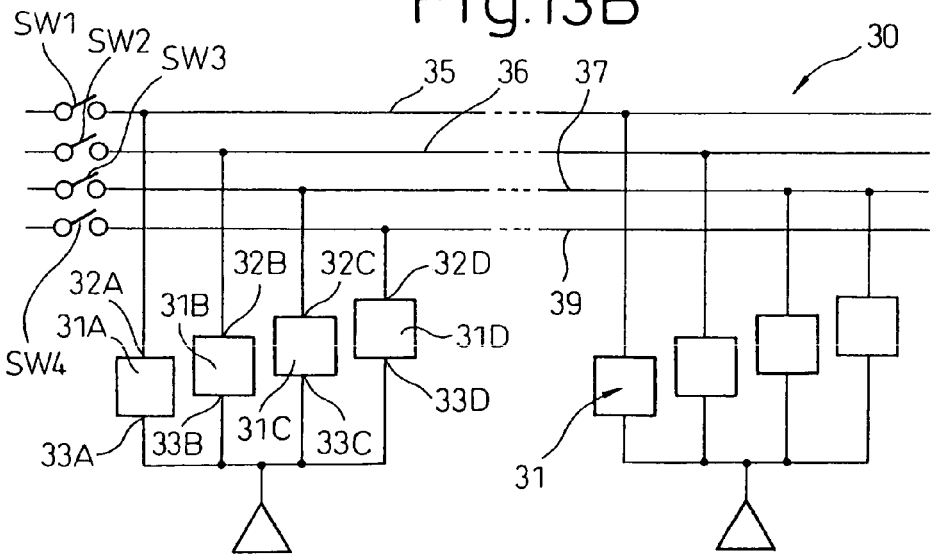
FIG. 13B is a diagram showing the configuration of a driving circuit for the liquid crystal shutter shown in FIG. 13A.

FIG. 13B is a diagram showing the configuration of a driving circuit for the liquid crystal pixel array 30 in the liquid crystal shutter shown in FIG. 13A. In the liquid crystal pixel array 30 according to the present embodiment, the four liquid crystal pixels 31 in each pixel group PG are denoted, for example, as the liquid crystal pixels 31A, 31B, 31C, and 31D, respectively. As shown, one electrode 32A of the liquid crystal cell forming the liquid crystal pixel 31A is connected to a first time-division line 35, one electrode 32B of the liquid crystal cell forming the liquid crystal pixel 31B is connected to a second time-division line 36, one electrode 32C of the liquid crystal cell forming the liquid crystal pixel 31C is connected to a third time-division line 37, and one electrode 32D of the liquid crystal cell forming the liquid crystal pixel 31D is connected to a fourth time-division line 39. The other electrodes 33A, 33B, 33C, and 33D of the liquid crystal pixels 31A, 31B, 31C, and 31D in the same pixel group PG are connected together, and then connected via a data line 38 to a corresponding one of the driver ICs 24 shown in FIG. 4A. The four liquid crystal pixels 31 in the adjacent pixel group PG are also connected in the same manner.

When the switch SW1 provided in the first time-division line 35 is on (the first time-division line 35 is selected), the liquid crystal pixels 31, which are connected in the respective pixel groups PG to the first time-division line 35, reach a light transmitting state; when the switch SW2 provided in the second time-division line 36 is on (the second time-division line 36 is selected), the liquid crystal pixels 31, which are connected in the respective pixel groups PG to the second time-division line 36, reach a light transmitting state; when the switch SW3 provided in the third time-division line 37 is on (the third time-division line 37 is selected), the liquid crystal pixels 31, which are connected in the respective pixel groups PG to the third time-division line 37, reach a light transmitting state; and when the switch SW4 provided in the fourth time-division line 39 is on (the fourth time-division line 39 is selected), the liquid crystal pixels 31, which are connected in the respective pixel groups PG to the fourth time-division line 39, reach a light transmitting state.

In this way, in the third embodiment, as only one electrode in each pixel group PG is connected to the driver IC 24, the total number of driver IC output pins can be reduced to one quarter the total number of liquid crystal pixels 31 contained in the liquid crystal pixel array 30. Here, each driver IC 24 has 160 drive pins; therefore, if the liquid crystal pixel array 30 consists of 480 pixels, then 480÷4=120, that is, only one driver IC need be provided. This means that the three driver ICs 24 shown in FIGS. 3 and 4 can be replaced in the third embodiment of the invention by one driver IC, and a substantial reduction in cost can thus be achieved.

Figure 14:
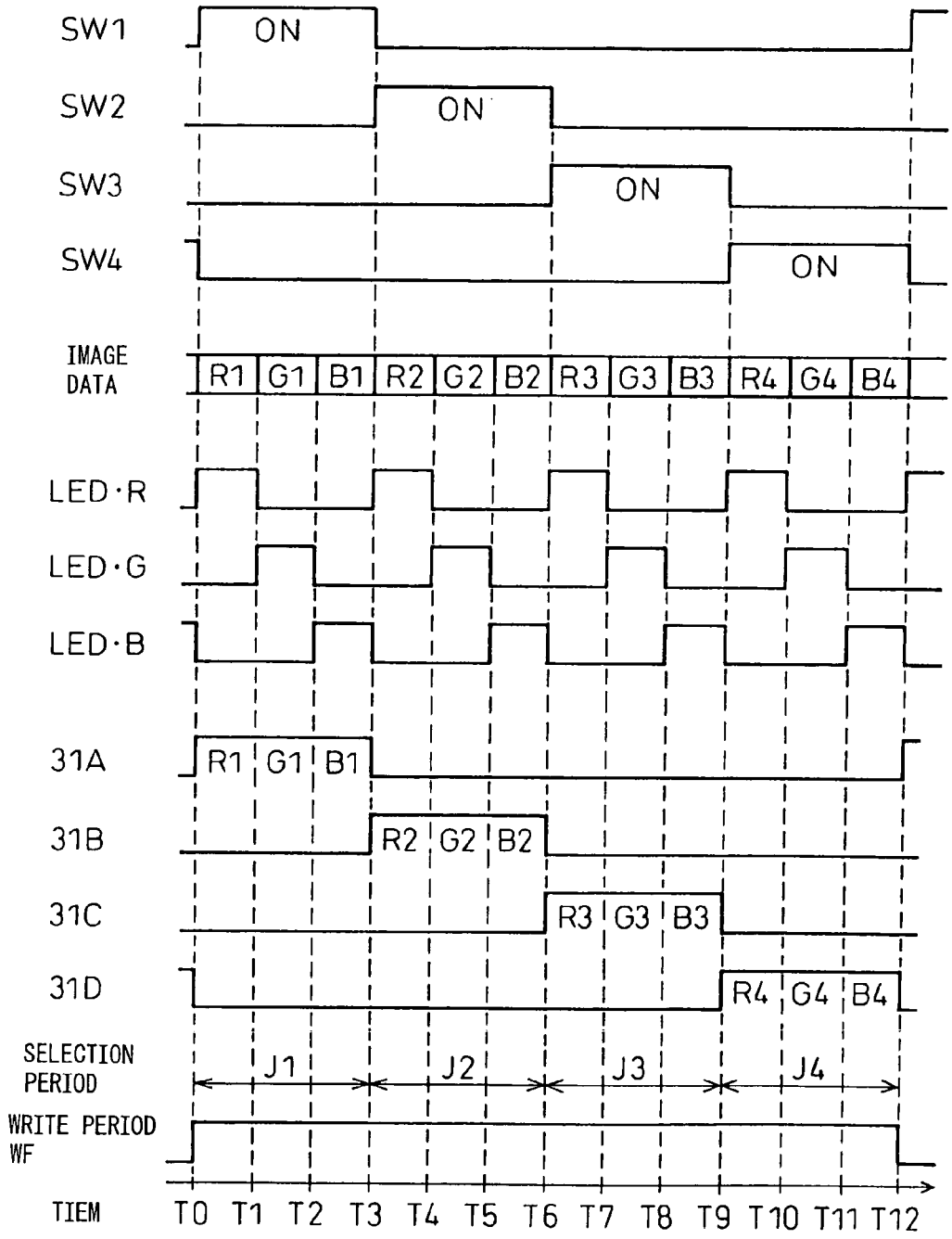
FIG. 14 is a waveform diagram showing driving waveforms for three adjacent liquid crystal pixels in the liquid crystal shutter according to the third embodiment of the present invention shown in FIG. 13.

FIG. 14 is a waveform diagram showing driving waveforms for various parts when the driver IC drives the four adjacent liquid crystal pixels contained in one pixel group PG in the liquid crystal pixel array 30 shown in FIG. 13B. The driving waveforms only for one pixel group PG will be described here because the driving waveforms for the liquid crystal pixels 31 in the other pixel groups PG are exactly the same as those shown here.

The selected/unselected states of the first to fourth time-division lines 35 to 37 and 39 shown in FIG. 13B will be described in conjunction with the operations of the switches SW1 to SW4 provided in the respective lines. At any instant in time, only one of the switches SW1 to SW4 is on, and the other switches remain off. During the period from time T0 to time T3, the switch SW1 is on; during the period from time T3 to time T6, the switch SW2 is on; during the period from time T6 to time T9, the switch SW3 is on; and during the period from time T9 to time T12, the switch SW4 is on. The length of the ON period is the same for each of the switches SW1 to SW4. Thereafter, the switches SW1 to SW4 repeatedly cycle between the ON and OFF states in a like manner.

In the T0 to T3 period during which the switch SW1 is on, the image data applied is the red data R1 from time T0 to time T1, the green data G1 from time T1 to time T2, and the blue data B1 from time T2 to time T3. Likewise, in the T3 to T6 period during which the switch SW2 is on, the image data applied is the red data R2 from time T3 to time T4, the green data G2 from time T4 to time T5, and the blue data B2 from time T5 to time T6. Further, in the T6 to T9 period during which the switch SW3 is on, the image data applied is the red data R3 from time T6 to time T7, the green data G3 from time T7 to time T8, and the blue data B3 from time T8 to time T9. Likewise, in the T9 to T12 period during which the switch SW4 is on, the image data applied is the red data R4 from time T9 to time T10, the green data G4 from time T10 to time T11, and the blue data B4 from time T11 to time T12. Thereafter, the red, green, and blue data are applied from the driver IC to the data line 38 in like manner as the switches SW1 to SW4 are turned on and off.

On the other hand, in the color light source 11 also, only one of the three color LEDs 11R, 11G, and 11B emits light at any instant in time. In the third embodiment, the red LED 11R emits light during the T0 to T1, T3 to T4, T6 to T7, and T9 to T10 periods in which the red data R1, R2, R3, and R4 are respectively applied. Likewise, the green LED 11G emits light during the T1 to T2, T4 to T5, T7 to T8, and T10 to T11 periods in which the green data G1, G2, G3, and G4 are respectively applied. Further, the blue LED 11B emits light during the T2 to T3, T5 to T6, T8 to T9, and T11 to T12 periods in which the blue data B1, B2, B3, and B4 are respectively applied. In this way, the three color LEDs 11R, 11G, and 11B in the color light source 11 emit light in sequence in accordance with the respective color data to be output on the data line 38.

When one of the switches SW1 to SW4 is on, the corresponding one of the four liquid crystal pixels 31A, 31B, 31C, and 31D is opened, allowing the colored light emitted from the corresponding LED to pass through for exposure on the photosensitive member 14.

Accordingly, the liquid crystal pixel 31A is opened in accordance with the red, green, and blue data R1, G1, and B1 applied in sequence during the T0 to T3 period in which the switch SW1 is on. That is, during the period from T0 to T1, the liquid crystal pixel 31A transmits the red light emitted from the LED 11R to expose the photosensitive member 14 in accordance with the red data R1. Then, during the period from T1 to T2, the liquid crystal pixel 31A transmits the green light emitted from the LED 11G to expose the photosensitive member 14 in accordance with the green data G1 in overlaying fashion on the red exposure. Further, during the period from T2 to T3, the liquid crystal pixel 31A transmits the blue light emitted from the LED 11B to expose the photosensitive member 14 in accordance with the blue data B1 in an overlaying fashion on the red and green exposures.

On the other hand, the liquid crystal pixel 31B is opened in accordance with the red, green, and blue data R2, G2, and B2 applied in sequence during the T3 to T6 period in which the switch SW2 is on. That is, during the period from T3 to T4, the liquid crystal pixel 31B transmits the red light emitted from the LED 11R to expose the photosensitive member 14 in accordance with the red data R2. Then, during the period from T4 to T5, the liquid crystal pixel 31B transmits the green light emitted from the LED 11G to expose the photosensitive member 14 in accordance with the green data G2 in overlaying fashion on the red exposure. Further, during the period from T5 to T6, the liquid crystal pixel 31B transmits the blue light emitted from the LED 11B to expose the photosensitive member 14 in accordance with the blue data B2 in an overlaying fashion on the red and green exposures.

Likewise, the liquid crystal pixel 31C is opened in accordance with the red, green, and blue data R3, G3, and B3 applied in sequence during the T6 to T9 period in which the switch SW3 is on. That is, during the period from T6 to T7, the liquid crystal pixel 31C transmits the red light emitted from the LED 11R to expose the photosensitive member 14 in accordance with the red data R3. Then, during the period from T7 to T8, the liquid crystal pixel 31C transmits the green light emitted from the LED 11G to expose the photosensitive member 14 in accordance with the green data G3 in overlaying fashion on the red exposure. Further, during the period from T8 to T9, the liquid crystal pixel 31C transmits the blue light emitted from the LED 11B to expose the photosensitive member 14 in accordance with the blue data B3 in overlaying fashion on the red and green exposures.

Further, the liquid crystal pixel 31D is opened in accordance with the red, green, and blue data R4, G4, and B4 applied in sequence during the T9 to T12 period in which the switch SW4 is on. That is, during the period from T9 to T10, the liquid crystal pixel 31D transmits the red light emitted from the LED 11R to expose the photosensitive member 14 in accordance with the red data R4. Then, during the period from T10 to T11, the liquid crystal pixel 31D transmits the green light emitted from the LED 11G to expose the photosensitive member 14 in accordance with the green data G4 in overlaying fashion on the red exposure. Further, during the period from T11 to T12, the liquid crystal pixel 31D transmits the blue light emitted from the LED 11B to expose the photosensitive member 14 in accordance with the blue data B4 in overlaying fashion on the red and green exposures.

In this way, in the third embodiment, each of the four liquid crystal pixels in each pixel group PG exposes the photosensitive member 14 in accordance with the red, green, and blue data in sequence with a prescribed cycle. When the exposure with the image data for one liquid crystal pixel is completed, the next adjacent liquid crystal pixel exposes the photosensitive member 14 in accordance with the red, green, and blue data in sequence with the same cycle; the same operation is repeated thereafter. Here also, the cycle with which each liquid crystal pixel in each pixel group PG performs exposures in accordance with the data of the respective colors is referred to as the selection period. As shown in FIG. 14, the selection period during which the first liquid crystal pixel performs exposures with the red, green, and blue colors is denoted by J1, the selection period during which the second liquid crystal pixel performs exposures with the respective colors is denoted by J2, the selection period during which the third liquid crystal pixel performs exposures with the respective colors is denoted by J3, and the selection period during which the fourth liquid crystal pixel performs exposures with the respective colors is denoted by J4. Here, the period corresponding to the sum of the four selection periods J1, J2, J3, and J4 is the write period WF.

The above has described the exposure operation performed on the photosensitive member 14 during the write period WF, and this operation is repeated after that. That is, in the present embodiment, as the number of liquid crystal pixels in each pixel group PG is 4, the write period WF required to complete the color exposures on the photosensitive member 14 is determined by the sum of the selection periods (J1=J2=J3=J4) during which the time-division lines 35 to 37 and 39 are respectively driven, the write period WF thus being equal to four times the selection period.

In the third embodiment also, the reason that the exposure with the data for the same color always starts at the same position when viewed along the direction orthogonal to the moving direction X of the liquid crystal pixel array 30 is because the relation H=h/N=h/4 holds, where h is the distance over which the photosensitive member 14 relatively moves during the write period WF, N is the number of liquid crystal pixels in each pixel group (N=4 in the present embodiment), and H is the distance by which the liquid crystal pixels are displaced relative to each other.

Further, in the present embodiment, the length L of each liquid crystal pixel 31 in the liquid crystal pixel array 30, measured along the direction of the relative movement, is set equal to h. While it is desirable that the length L of each liquid crystal pixel 31 in the liquid crystal pixel array 30, measured along the direction of the relative movement, be set equal to the distance h, the length L may not necessarily be made equal to the distance h.

The present invention has been described above for the cases of N=3 (first embodiment), N=2 (second embodiment), and N=4 (third embodiment), but it will be appreciated that, in the exposure procedures described above, the number N is not limited to those given in the respective embodiments.

(4) Embodiment 4

Next, a fourth embodiment of the present invention will be described; in this embodiment, the liquid crystal pixels 31 constituting the liquid crystal pixel array 30 are divided into pixel groups PG of three pixels each, and the three liquid crystal pixels 31 in each pixel group PG are arranged one displaced from another by L/9 (L is the length of each liquid crystal pixel 31 measured along the direction of the relative movement of the photosensitive member). In this embodiment, the color exposures are performed using procedures different to those described in the foregoing first to third embodiments.

Figure 15:
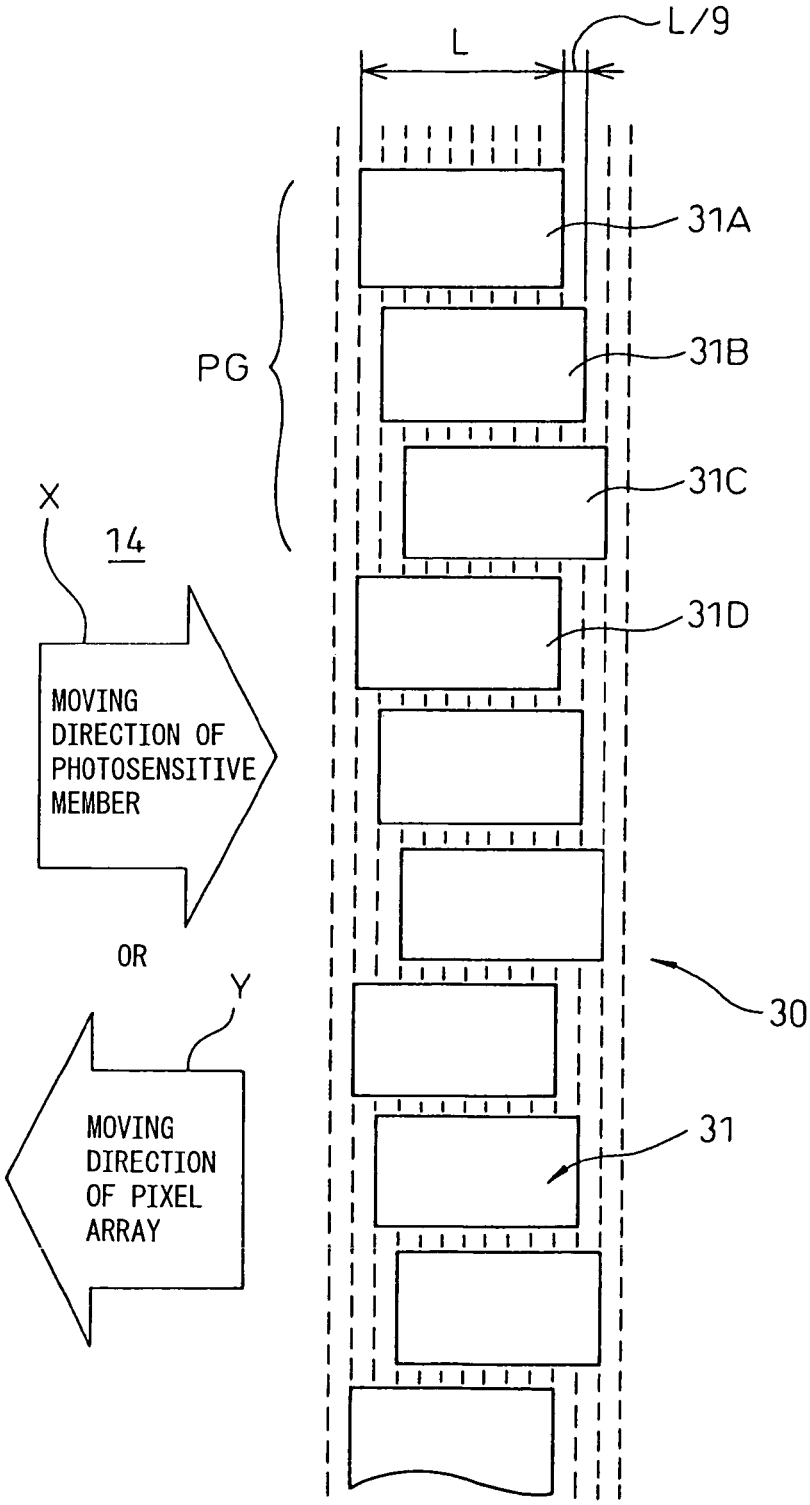
FIG. 15 is an enlarged plan view showing partially an arrangement of liquid crystal pixels in the liquid crystal shutter according to a fourth embodiment of the present invention.

FIG. 15 is a diagram showing in detail the arrangement of the liquid crystal pixels 31 in the liquid crystal pixel array 30 according to the fourth embodiment of the present invention. As shown, the three liquid crystal pixels 31 in each pixel group PG are arranged one displaced from another by L/9, where L is the overall length of each liquid crystal pixel 31 measured along the direction of the relative movement of the photosensitive member. The direction in which the liquid crystal pixels 31 are displaced is the same as the moving direction of the photosensitive member (shown by arrow X in FIG. 15), that is, the direction from the upstream to the downstream side. More specifically, in the same pixel group PG, the liquid crystal pixel 31B adjacent to the liquid crystal pixel 31A is displaced by L/9 in the downstream direction, and the liquid crystal pixel 31C adjacent to the liquid crystal pixel 31B is displaced by L/9 in the downstream direction. The position of the first liquid crystal pixel 31D in the adjacent pixel group PG is the same as the position of the liquid crystal pixel 31A. The same applies to the case in which the liquid crystal pixel array 30 is moved relative to the photosensitive member in the direction shown by arrow Y in FIG. 15.

Figure 16:
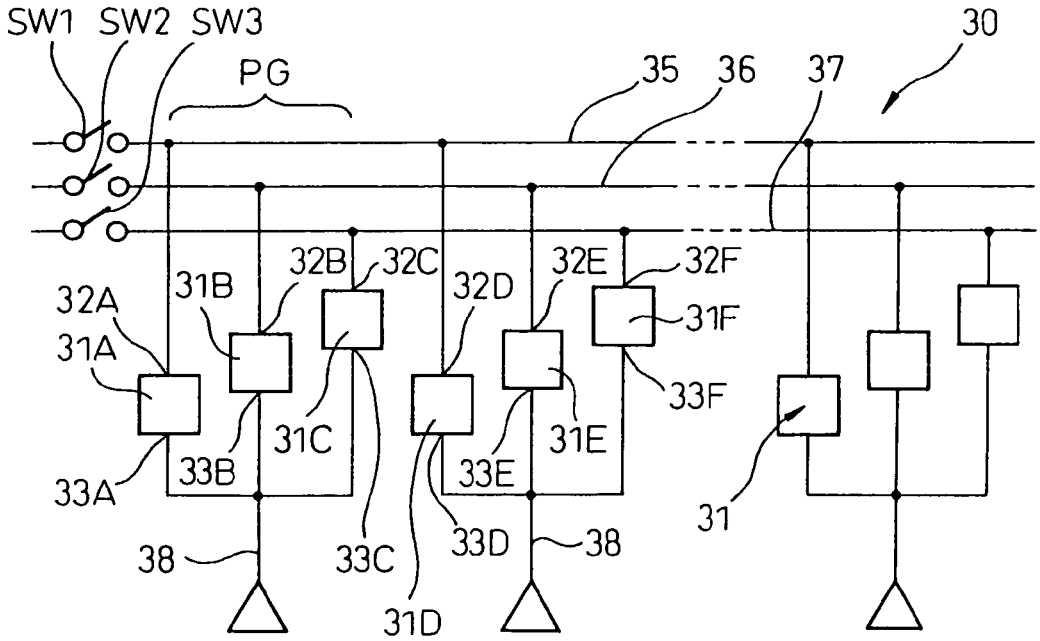
FIG. 16 is a diagram showing the configuration of a driving circuit for the liquid crystal pixel array in the liquid crystal shutter according to the fourth embodiment of the present invention shown in FIG. 15.

FIG. 16 is a diagram showing the configuration of a driving circuit for the liquid crystal pixel array 30 in the liquid crystal shutter according to the fourth embodiment of the present invention shown in FIG. 15. In the liquid crystal pixel array 30 shown in FIG. 16, the liquid crystal pixels 31 constituting the liquid crystal pixel array 30 are divided into pixel groups PG of three pixels each. Here, the three liquid crystal pixels 31 in each pixel group PG are denoted, for example, as the liquid crystal pixels 31A, 31B, and 31C, respectively. As shown, one electrode 32A of the liquid crystal cell forming the liquid crystal pixel 31A is connected to a first time-division line 35, and one electrode 32B of the liquid crystal cell forming the liquid crystal pixel 31B is connected to a second time-division line 36, while one electrode 32C of the liquid crystal cell forming the liquid crystal pixel 31C is connected to a third time-division line 37. The other electrodes 33A, 33B, and 33C of the liquid crystal pixels 31A, 31B, and 31C in the same pixel group PG are connected together, and then connected via a data line 38 to a corresponding one of the driver ICs 24 shown in FIG. 4A.

When the three liquid crystal pixels 31 in the adjacent pixel group PG are denoted, for example, as the liquid crystal pixels 31D, 31E, and 31F, respectively, the liquid crystal pixel 31D is connected in the same way as its corresponding liquid crystal pixel 31A, and the liquid crystal pixel 31E is connected in the same way as its corresponding liquid crystal pixel 31B, while the liquid crystal pixel 31F is connected in the same way as its corresponding liquid crystal pixel 31C. When the first time-division line 35 is selected (the other time-division lines are unselected), the liquid crystal pixels 31, which are connected in the respective pixel groups PG to the first time-division line 35, reach a light transmitting state; when the second time-division line 36 is selected, the liquid crystal pixels 31, which are connected in the respective pixel groups PG to the second time-division line 36, reach a light transmitting state; and when the third time-division line 37 is selected, the liquid crystal pixels 31, which are connected in the respective pixel groups PG to the third time-division line 37, reach a light transmitting state.

In this way, in the fourth embodiment, as only one electrode in each pixel group PG is connected to the driver IC 24, the total number of driver IC output pins can be reduced to one third the total number of liquid crystal pixels 31 contained in the liquid crystal pixel array 30. Here, each driver IC 24 has 160 drive pins; therefore, if the liquid crystal pixel array 30 consists of 480 pixels, then 480÷3=160, that is, only one driver IC need be provided. This means that the three driver ICs 24 shown in FIGS. 3 and 4 can be replaced in the present embodiment by one driver IC, and a substantial reduction in cost can thus be achieved.

Figure 17:
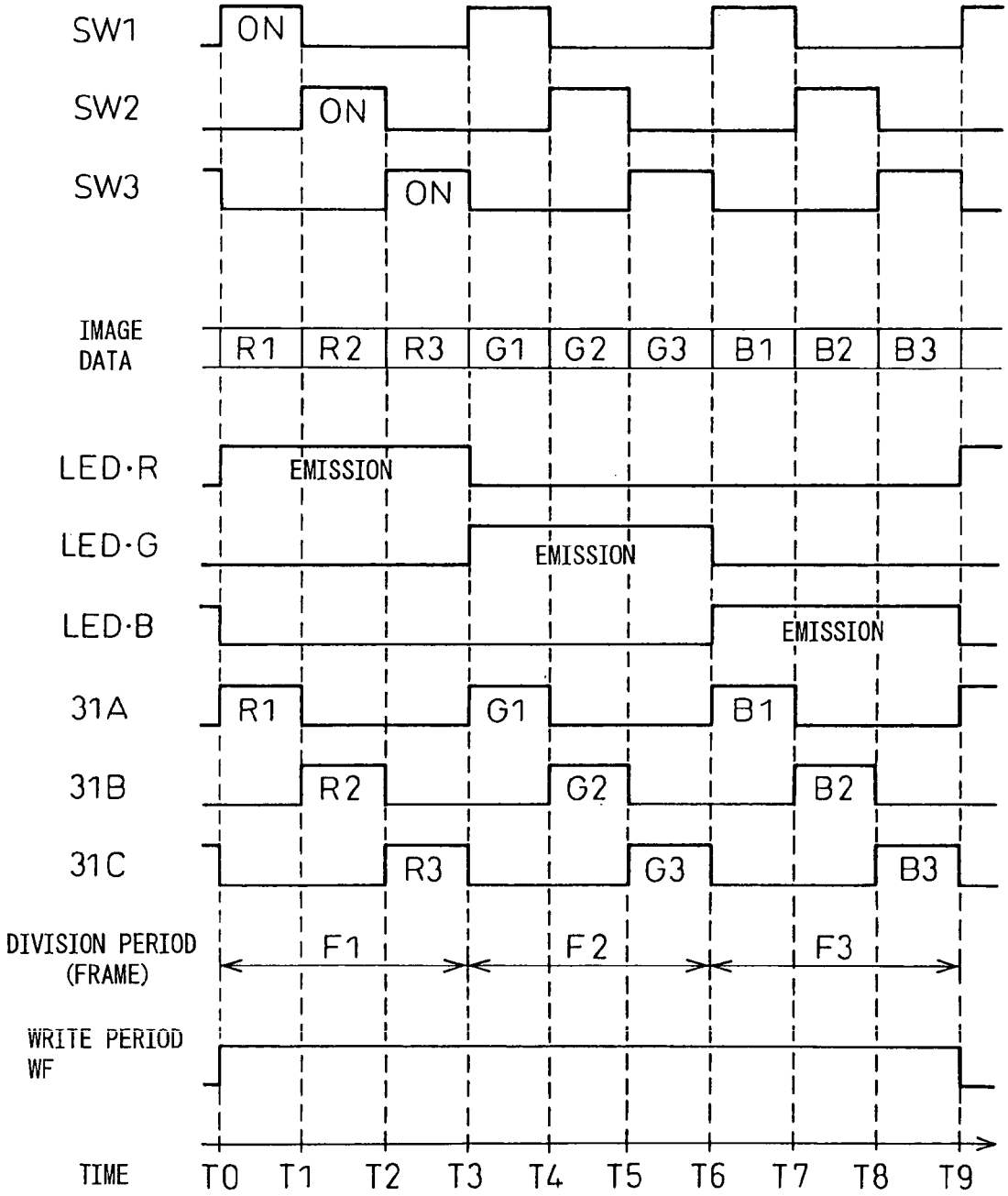
FIG. 17 is a waveform diagram showing driving waveforms for three adjacent liquid crystal pixels in the liquid crystal shutter according to the fourth embodiment of the present invention shown in FIG. 16.

FIG. 17 is a waveform diagram showing driving waveforms for various parts when the driver IC drives the three adjacent liquid crystal pixels contained in one pixel group PG in the liquid crystal pixel array 30 shown in FIG. 16. The driving waveforms for only one pixel group PG will be described here, as the driving waveforms for the liquid crystal pixels 31 in the other pixel groups PG are exactly the same as those shown here.

First, the selected/unselected states of the first, second, and third time-division lines 35, 36, and 37 shown in FIG. 16 will be described in conjunction with the operations of the switches SW1, SW2, and SW3. As earlier described, the switch ON state is the state in which the corresponding time-division line is selected, while the OFF state is the state in which the corresponding time-division line is unselected. At any instant in time, only one of the switches SW1 to SW3 is on, and the other switches remain off. During the period from time T0 to time T1, the switch SW1 is on. During the next period from time T1 to time T2, the switch SW2 is on. During the subsequent period from time T2 to time T3, the switch SW3 is on. The length of the ON period is the same for each of the switches SW1 to SW3. When the ON period of the switch SW3 ends at time T3, the switch SW1 again turns on at time T3 and remains on till time T4. After that, the witch SW2 is on from time T4 to time T5, and the switch SW3 is on from time T5 to time T6. Thereafter, the switches SW1 to SW3 repeatedly cycle between the ON and OFF states in a like manner.

In this way, the first to third time-division lines 35 to 37 are respectively selected in cyclic fashion; in the present embodiment, the period during which each time-division line is selected (for example, the period from time T0 to time T3) is called the division period.

In the T0 to T1 period during which the switch SW1 is on, the image data applied is the red data R1; in the T1 to T2 period during which the switch SW2 is on, the image data applied is the red data R2; and in the T2 to T3 period during which the switch SW3 is on, the image data applied is the red data R3. On the other hand, in the T3 to T4 period during which the switch SW1 is on, the image data applied is the green data G1; in the T4 to T5 period during which the switch SW2 is on, the image data applied is the green data G2; and in the T5 to T6 period during which the switch SW3 is on, the image data applied is the green data G3. Further, in the T6 to T7 period during which the switch SW1 is on, the image data applied is the blue data B1; in the T7 to T8 period during which the switch SW2 is on, the image data applied is the blue data B2; and in the T8 to T9 period during which the switch SW3 is on, the image data applied is the blue data B3.

On the other hand, in the color light source 11 also, only one of the three color LEDs 11R, 11G, and 11B is on at any instant in time. In the present embodiment, the red LED 11R emits light during the period from time T0 to time T3 in which the red data R1 to R3 are applied; the green LED 11G emits light during the period from time T3 to time T6 in which the green data G1 to G3 are applied; and the blue LED 11B emits light during the period from time T6 to time T9 in which the blue data B1 to B3 are applied. In this way, the three color LEDS 11R, 11G, and 11B in the color light source 11 emit lights on in sequence in accordance with the respective color data to be output on the data line 38.

When the data voltage, i.e., image data, is applied with one of the switches SW1 to SW3 in the ON state, the corresponding one of the three liquid crystal pixels 31A, 31B, and 31C reach a light transmitting state, allowing the colored light emitted from the corresponding LED to pass through for exposure on the photosensitive member 14.

Accordingly, the liquid crystal pixel 31A is opened in accordance with the red data R1 during the period from time T0 to time T1, and transmits the red light emitted from the LED 11R to expose the photosensitive member 14. Likewise, the liquid crystal pixel 31A is opened in accordance with the green data G1 during the period from time T3 to time T4, and transmits the green light emitted from the LED 11G to expose the photosensitive member 14. Further, the liquid crystal pixel 31A is opened in accordance with the blue data B1 during the period from time T6 to time T7, and transmits the blue light emitted from the LED 11B to expose the photosensitive member 14.

On the other hand, the liquid crystal pixel 31B is opened in accordance with the red data R2 during the period from time T1 to time T2, and transmits the red light emitted from the LED 11R to expose the photosensitive member 14. Likewise, the liquid crystal pixel 31B is opened in accordance with the green data G2 during the period from time T4 to time T5, and transmits the green light emitted from the LED 11G to expose the photosensitive member 14. Further, the liquid crystal pixel 31B is opened in accordance with the blue data B2 during the period from time T7 to time T8, and transmits the blue light emitted from the LED 11B to expose the photosensitive member 14.

Likewise, the liquid crystal pixel 31C is opened in accordance with the red data R3 during the period from time T2 to time T3, and transmits the red light emitted from the LED 11R to expose the photosensitive member 14. Likewise, the liquid crystal pixel 31C is opened in accordance with the green data G3 during the period from time T5 to time T6, and transmits the green light emitted from the LED 11G to expose the photosensitive member 14. Further, the liquid crystal pixel 31C is opened in accordance with the blue data B3 during the period from time T8 to time T9, and transmits the blue light emitted from the LED 11B to expose the photosensitive member 14.

In this way, in the fourth embodiment, the three liquid crystal pixels in each pixel group PG sequentially expose the photosensitive member 14 first in accordance with the red data, then in accordance with the green data, and then in accordance with the blue data; this operation is repeated with a prescribed cycle. In this embodiment, the cycle with which each pixel group performs exposure with the data of one color is referred to as the division period (frame period). As shown in FIG. 17, the division period for exposure with red color is denoted by F1, the division period for exposure with green color is denoted by F2, and the division period for exposure with blue color is denoted by F3. Here, the three division periods F1, F2, and F3 combined are called the write period WF.

Figure 18A:
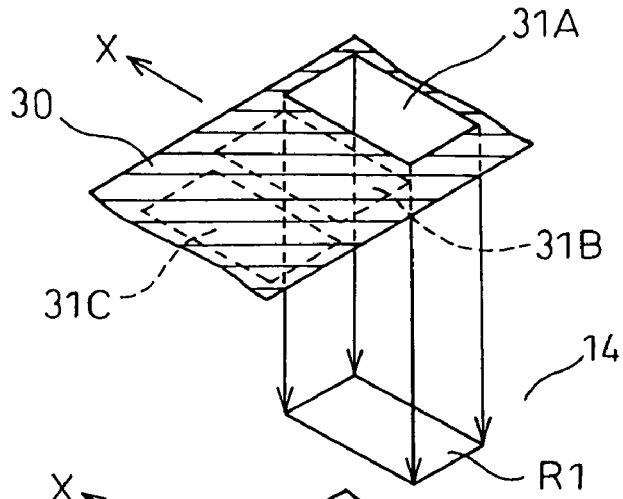
FIG. 18A is an explanatory diagram showing the operation of the liquid crystal shutter during the period from time T0 to time T1 in FIG. 17 and the data written during the same period.
Figure 18B:
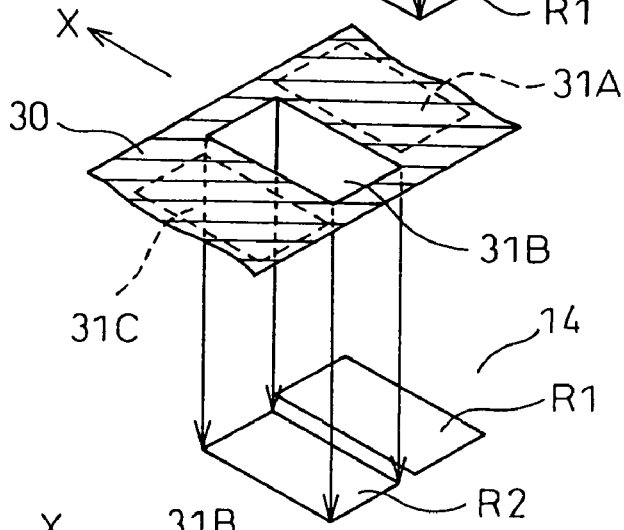
FIG. 18B is an explanatory diagram showing the operation of the liquid crystal shutter during the period from time T1 to time T2 in FIG. 17 and the data written during the same period.
Figure 18C:
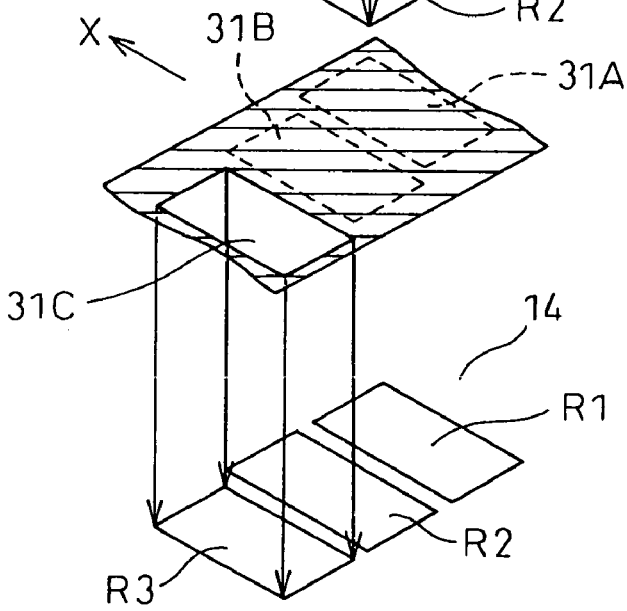
FIG. 18C is an explanatory diagram showing the operation of the liquid crystal shutter during the period from time T2 to time T3 in FIG. 17 and the data written during the same period.

FIGS. 18A to 18C are diagrams showing a portion of the liquid crystal pixel array 30, for explaining how the three liquid crystal pixels 31A, 31B, and 31C in one pixel group PG perform exposures with the red data during the division period F1, and how the image data are applied for exposure of the photosensitive member 14 during the same period. It is assumed here that the liquid crystal pixel array 30 is moved relative to the photosensitive member 14 in the direction of arrow X, and the hatched area indicates the light blocking area.

FIG. 18A is a diagram showing the operation of the liquid crystal pixels 31A, 31B, and 31C during the period from T0 to T1 in FIG. 17 and the data written during the same period. During this period, the liquid crystal pixel 31A is open, so that the red light from the LED 11R passes through the liquid crystal pixel 31A as shown by arrows, to expose the photosensitive member 14 in accordance with the red data R1. FIG. 18B is a diagram showing the operation of the liquid crystal pixels 31A, 31B, and 31C during the period from T1 to T2 in FIG. 17 and the data written during the same period. During this period, the liquid crystal pixel 31B is open, so that the red light from the LED 11R passes through the liquid crystal pixel 31B as shown by arrows, to expose the photosensitive member 14 in accordance with the red data R2. FIG. 18C is an explanatory diagram showing the operation of the liquid crystal pixels 31A, 31B, and 31C during the period from T2 to T3 in FIG. 17 and the data written during the same period. During this period, the liquid crystal pixel 31C is open, so that the red light from the LED 11R passes through the liquid crystal pixel 31C as shown by arrows, to expose the photosensitive member 14 in accordance with the red data R3.

Here, as the liquid crystal pixel array 30 is constantly moving in the direction of arrow X during the exposure, the area exposed with the image data R1, for example, may become larger than the area of the liquid crystal pixel 31A. Further, as the moving distance of the liquid crystal pixel array 30 from time T0 to T1 is equal to the amount of displacement between the liquid crystal pixels 31A and 31B, the exposure start position of the image data R2 is the same as the exposure start position of the image data R1 when viewed along the direction orthogonal to the moving direction of the liquid crystal pixel array 30. For the same reason, the exposure start position of the image data R3 is the same as that of the image data R2.

Figure 19A:
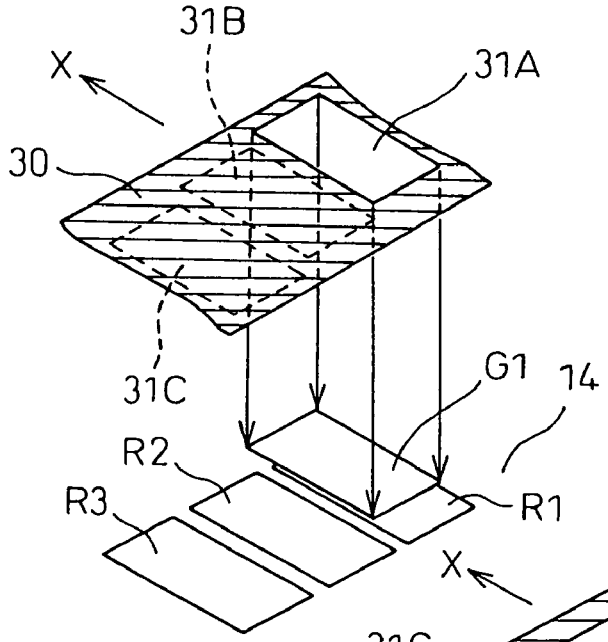
FIG. 19A is an explanatory diagram showing the operation of the liquid crystal shutter during period from time T3 to time T4 in FIG. 17 and the data written during the same period.
Figure 19B:
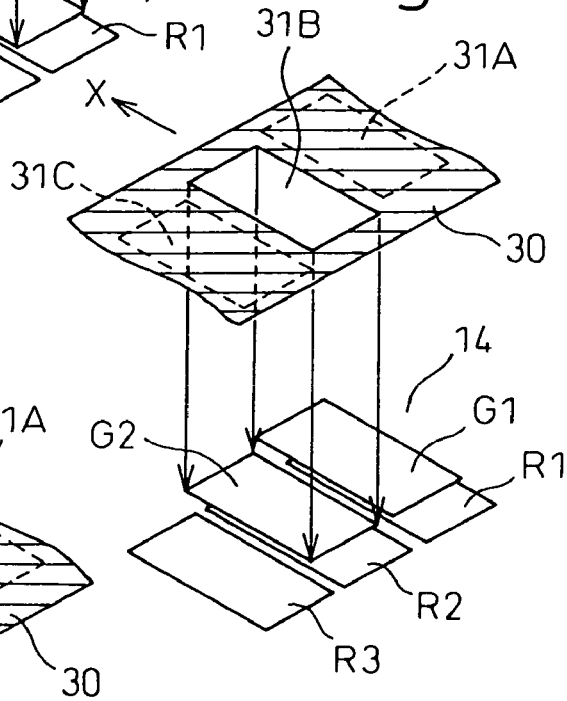
FIG. 19B is an explanatory diagram showing the operation of the liquid crystal shutter during period from time T4 to time T5 in FIG. 17 and the data written during the same period.
Figure 19C:
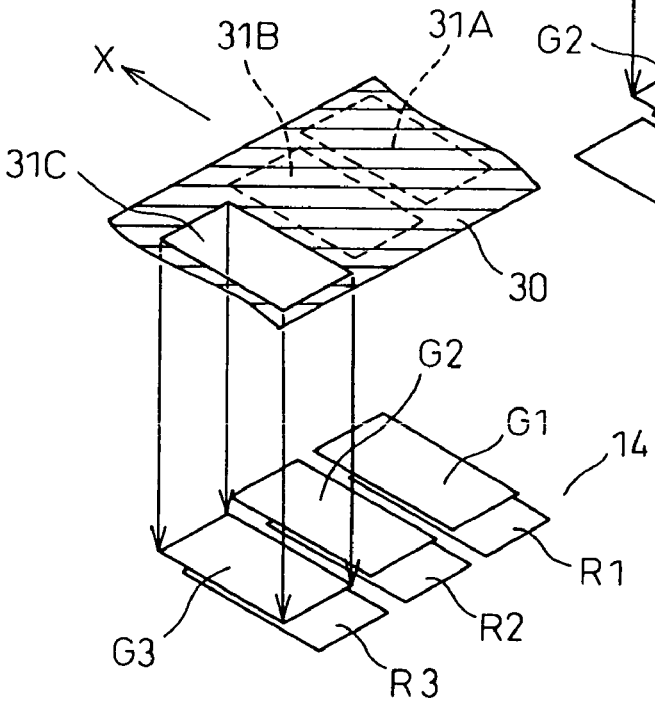
FIG. 19C is an explanatory diagram showing the operation of the liquid crystal shutter during period from time T5 to time T6 in FIG. 17 and the data written during the same period.

FIGS. 19A to 19C are also diagrams showing a portion of the liquid crystal pixel array 30, for explaining how the three liquid crystal pixels 31A, 31B, and 31C in one pixel group PG perform exposures with the green data during the division period F2, and how the image data are applied for exposure of the photosensitive member 14 during the same period. Here also, it is assumed that the liquid crystal pixel array 30 is moved relative to the photosensitive member 14 in the direction of arrow X, and the hatched area indicates the light blocking area.

FIG. 19A is a diagram showing the operation of the liquid crystal pixels 31A, 31B, and 31C during the period from T3 to T4 in FIG. 17 and the data written during the same period. During this period, the liquid crystal pixel 31A is open, so that the green light from the LED 11G passes through the liquid crystal pixel 31A as shown by arrows, to expose the photosensitive member 14 in accordance with the green data G1 in an overlaying fashion on the red exposure performed with the red data R1. FIG. 19B is a diagram showing the operation of the liquid crystal pixels 31A, 31B, and 31C during the period from T4 to T5 in FIG. 17 and the data written during the same period. During this period, the liquid crystal pixel 31B is open, so that the green light from the LED 11G passes through the liquid crystal pixel 31B as shown by arrows, to expose the photosensitive member 14 in accordance with the green data G2 in an overlaying fashion on the red exposure performed with the red data R2. FIG. 19C is an explanatory diagram showing the operation of the liquid crystal pixels 31A, 31B, and 31C during the period from T5 to T6 in FIG. 17 and the data written during the same period. During this period, the liquid crystal pixel 31C is open, so that the green light from the LED 11G passes through the liquid crystal pixel 31C as shown by arrows, to expose the photosensitive member 14 in accordance with the green data G3 in an overlaying fashion on the red exposure performed with the red data R3.

In this case also, the areas exposed with the image data G1, G2, and G3 may become larger than the areas of the respective liquid crystal pixel 31A, 31B, and 31C. Further, the exposure start positions of the image data G1, G2, and G3 are the same when viewed along the direction orthogonal to the moving direction X of the liquid crystal pixel array 30.

Figure 20A:
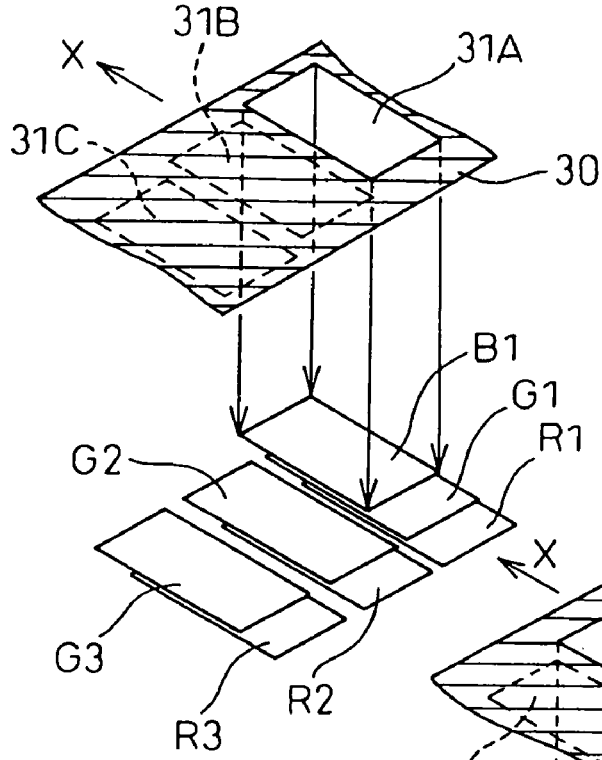
FIG. 20A is an explanatory diagram showing the operation of the liquid crystal shutter during the period from time T6 to time T7 in FIG. 17 and the data written during the same period.
Figure 20B:
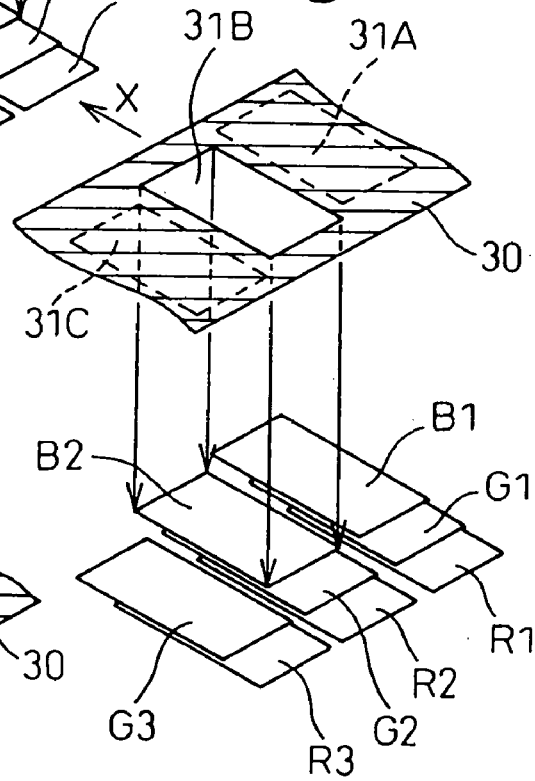
FIG. 20B is an explanatory diagram showing the operation of the liquid crystal shutter during period from time T7 to time T8 in FIG. 17 and the data written during the same period.
Figure 20C:
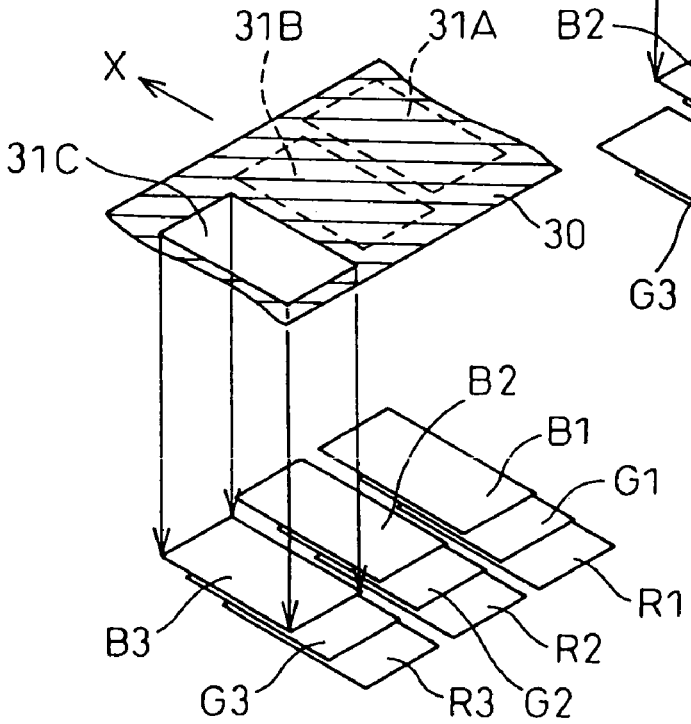
FIG. 20C is an explanatory diagram showing the operation of the liquid crystal shutter during period from time T8 to time T9 in FIG. 17 and the data written during the same period.

FIGS. 20A to 20C are also diagrams showing a portion of the liquid crystal pixel array 30, for explaining how the three liquid crystal pixels 31A, 31B, and 31C in one pixel group PG perform exposures with the blue data during the division period F3, and how the image data are applied for exposure of the photosensitive member 14 during the same period. Here also, it is assumed that the liquid crystal pixel array 30 is moved relative to the photosensitive member 14 in the direction of arrow X, and the hatched area indicates the light blocking area.

FIG. 20A is a diagram showing the operation of the liquid crystal pixels 31A, 31B, and 31C during the period from T6 to T7 in FIG. 17 and the data written during the same period. During this period, the liquid crystal pixel 31A is open, so that the blue light from the LED 11B passes through the liquid crystal pixel 31A as shown by arrows, to expose the photosensitive member 14 in accordance with the blue data B1 in an overlaying fashion on the exposure performed with the image data G1. FIG. 20B is a diagram showing the operation of the liquid crystal pixels 31A, 31B, and 31C during the period from T7 to T8 in FIG. 17 and the data written during the same period. During this period, the liquid crystal pixel 31B is open, so that the blue light from the LED 11B passes through the liquid crystal pixel 31B as shown by arrows, to expose the photosensitive member 14 in accordance with the blue data B2 in an overlaying fashion on the exposure performed with the image data G2. FIG. 20C is an explanatory diagram showing the operation of the liquid crystal pixels 31A, 31B, and 31C during the period from T8 to T9 in FIG. 17 and the data written during the same period. During this period, the liquid crystal pixel 31C is open, so that the blue light from the LED 11B passes through the liquid crystal pixel 31C as shown by arrows, to expose the photosensitive member 14 in accordance with the blue data B3 in an overlaying fashion on the exposure performed with the image data G3.

In this case also, the areas exposed with the image data B1, B2, and B3 may become larger than the areas of the respective liquid crystal pixel 31A, 31B, and 31C. Further, the exposure start positions of the image data B1, B2, and B3 are the same when viewed along the direction orthogonal to the moving direction X of the liquid crystal pixel array 30.

Here, the reason that the exposure with the image data of the same color always starts at the same position when viewed along the direction orthogonal to the moving direction X of the liquid crystal pixel array 30 is because the relation H=h/NM=h/9 holds, where h is the distance over which the photosensitive member 14 relatively moves during the write period WF, N is the number of liquid crystal pixels in each pixel group (N=3 in the present embodiment), M is the number of colors produced by the color light source (M=3 in the present embodiment), and H is the distance by which the liquid crystal pixels are displaced relative to each other.

In the present embodiment, L is set equal to h. While it is desirable that the length L of each liquid crystal pixel 31 in the liquid crystal pixel array 30, measured along the direction of the relative movement, be set equal to the distance h, the length L may not necessarily be made equal to the distance h.

The above has described the exposure operation performed on the photosensitive member 14, during the write period WF shown in FIG. 17, and this operation is repeated after that. That is, in the fourth embodiment, as the number of liquid crystal pixels in each pixel group PG is three, the write period WF required to complete the color exposures on the photosensitive member 14 is determined by the product of the division period (F1=F2=F3), during which the time-division lines 35 to 37 are driven in time-division fashion, and the number of colors, three, of the color light source 11, the write period WF thus being equal to three times the division period.

(5) Embodiment 5

Next, a fifth embodiment of the present invention will be described; in this embodiment, the liquid crystal pixels 31 constituting the liquid crystal pixel array 30 are divided into pixel groups PG of two pixels each, and the two liquid crystal pixels 31 in each pixel group PG are arranged one displaced from the other by L/6 (L is the length of each liquid crystal pixel 31 measured along the direction of the relative movement of the photosensitive member). In this embodiment, the color exposures are performed using different procedures than those described in the first to third embodiments.

Figure 21A:
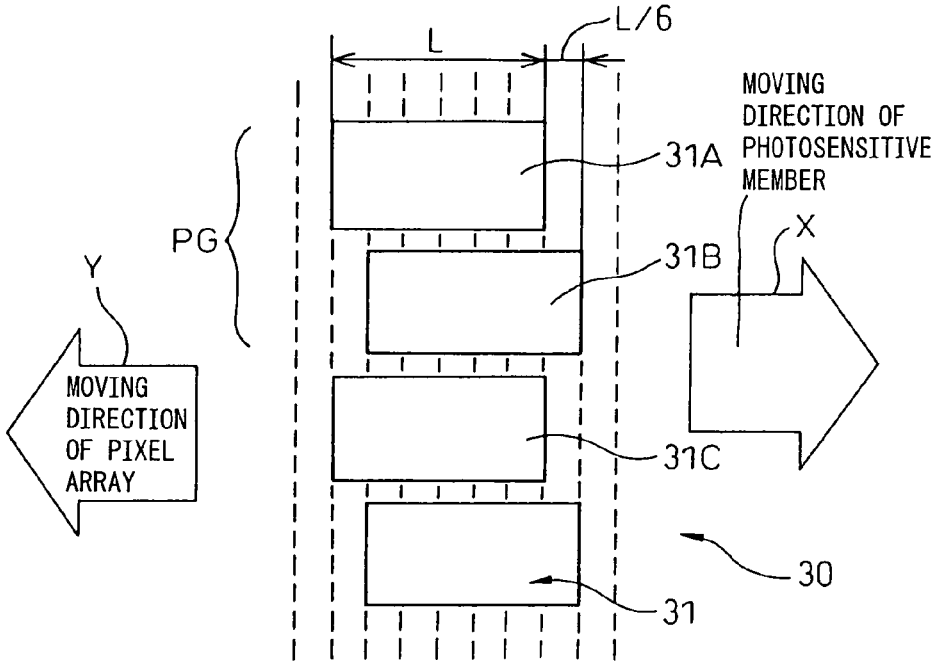
FIG. 21A is an enlarged plan view showing partially an arrangement of liquid crystal pixels in the liquid crystal shutter according to a fifth embodiment of the present invention.

FIG. 21A is an enlarged view showing the configuration of the liquid crystal pixel array 30 in the liquid crystal shutter according to the fifth embodiment of the present invention. In this embodiment, the liquid crystal pixels 31 constituting the liquid crystal pixel array 30 are divided into pixel groups PG of two pixels each. As shown, the two liquid crystal pixels 31 in each pixel group PG are arranged one displaced from the other by L/6, where L is the overall length of each liquid crystal pixel 31 measured along the direction of the relative movement of the photosensitive member. The direction in which the liquid crystal pixels 31 are displaced is the same as the moving direction of the photosensitive member (shown by arrow X in FIG. 21A), that is, the direction from the upstream to the downstream side. More specifically, in the same pixel group PG, the liquid crystal pixel 31B adjacent to the liquid crystal pixel 31A is displaced by L/6 in the downstream direction. The position of the first liquid crystal pixel 31C in the adjacent pixel group PG is the same as the position of the liquid crystal pixel 31A. The same applies to the case in which the liquid crystal pixel array 30 is moved relative to the photosensitive member in the direction shown by arrow Y in FIG. 21A.

Figure 21B:
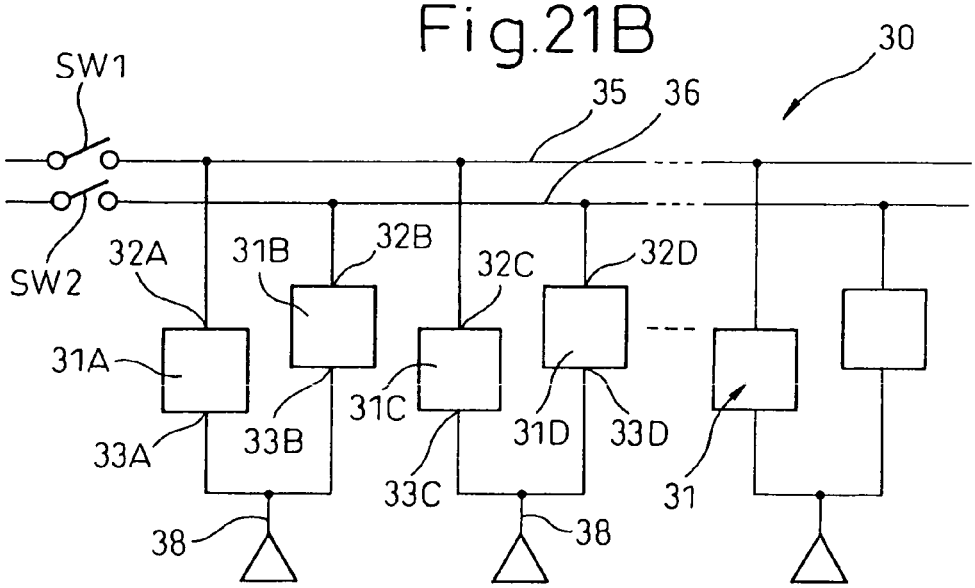
FIG. 21B is a diagram showing the configuration of a driving circuit for the liquid crystal shutter shown in FIG. 21A.

FIG. 21B is a diagram showing the configuration of a driving circuit for the liquid crystal pixel array 30 in the liquid crystal shutter shown in FIG. 21A. In the liquid crystal pixel array 30, the liquid crystal pixels 31 constituting the liquid crystal pixel array 30 are divided into pixel groups PG of two pixels each. When the two liquid crystal pixels 31 in each pixel group PG are denoted, for example, as the liquid crystal pixels 31A and 31B, respectively, one electrode 32A of the liquid crystal cell forming the liquid crystal pixel 31A is connected to a first time-division line 35, and one electrode 32B of the liquid crystal cell forming the liquid crystal pixel 31B is connected to a second time-division line 36. The other electrodes 33A and 33B of the liquid crystal pixels 31A and 31B in the same pixel group PG are connected together, and then connected via a data line 38 to a corresponding one of the driver ICs 24 shown in FIG. 4A.

When the two liquid crystal pixels 31 in the adjacent pixel group PG are denoted, for example, as the liquid crystal pixels 31C and 31D, respectively, the liquid crystal pixel 31C is connected in the same way as its corresponding liquid crystal pixel 31A, and the liquid crystal pixel 31D is connected in the same way as its corresponding liquid crystal pixel 31B. Here, when the switch SW1 provided in the first time-division line 35 is on (the first time-division line 35 is selected), the liquid crystal pixels 31 that are connected in the respective pixel groups PG to the first time-division line 35 are put in a light transmitting state; on the other hand, when the switch SW2 provided in the second time-division line 36 is on (the second time-division line 36 is selected), the liquid crystal pixels 31 that are connected in the respective pixel groups PG to the second time-division line 36 are put in a light transmitting state.

In this way, in the present embodiment, only one electrode in each pixel group PG is connected to the driver IC 24; therefore, when each pixel group PG consists of two liquid crystal pixels 31, the total number of driver IC output pins can be reduced to one half the total number of liquid crystal pixels 31 contained in the liquid crystal pixel array 30. Here, each driver IC 24 has 160 drive pins; therefore, if the liquid crystal pixel array 30 consists of 480 pixels, then 480÷2=240, that is, only two driver ICs need be provided. This means that the three driver ICs 24 shown in FIGS. 3 and 4 can be replaced in the present embodiment by two driver ICs, and a substantial reduction in cost can thus be achieved.

Figure 22:
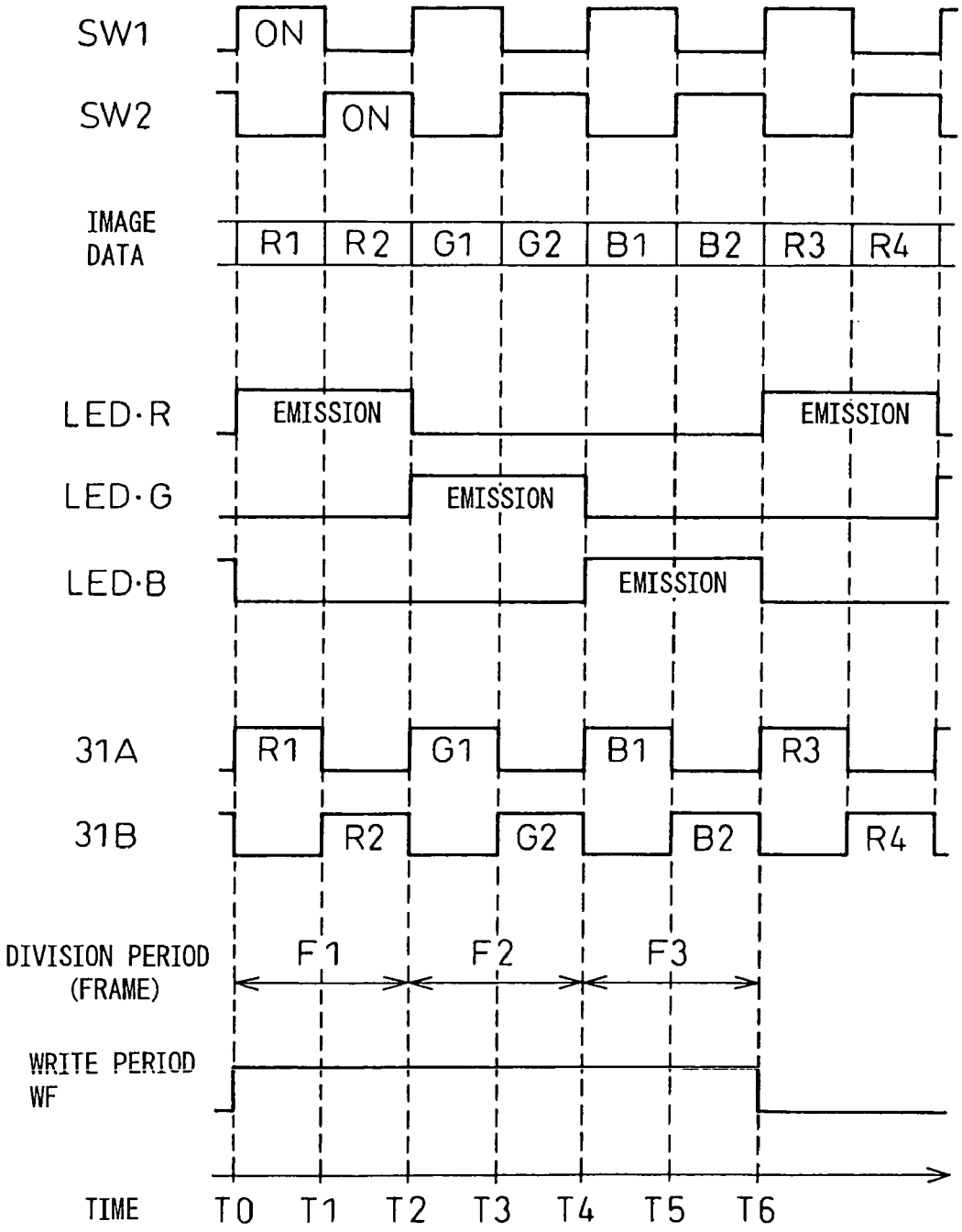
FIG. 22 is a waveform diagram showing driving waveforms for three adjacent liquid crystal pixels in the liquid crystal shutter according to the fifth embodiment of the present invention shown in FIG. 21.

FIG. 22 is a waveform diagram showing driving waveforms for various parts when the driver IC drives the two adjacent liquid crystal pixels contained in one pixel group PG in the liquid crystal shutter shown in FIG. 21B. The driving waveforms only for one pixel group PG will be described here, as the driving waveforms for the liquid crystal pixels 31 in the other pixel groups PG are exactly the same as those shown here.

In the fifth embodiment also, the selected/unselected states of the first and second time-division lines 35 and 36 shown in FIG. 21B will be described in conjunction with the operations of the switches SW1 and SW2 provided in the respective lines. At any instant in time, only one of the switches SW1 or SW2 is on, and the other switch remains off. During the period from time T0 to time T1, the switch SW1 is on. During the next period from time T1 to time T2, the switch SW2 is on. The length of the ON period is the same for both the switches SW1 and SW2. When the ON period of the switch SW2 ends at time T2, the switch SW1 again turns on at time T2 and remains on till time T3. After that, the switch SW2 is on from time T3 to time T4; thereafter, the switches SW1 and SW2 repeatedly cycle between the ON and OFF states in a like manner.

Next, a description will be given of the image data applied from the driver IC to the data line 38. In the T0 to T1 period during which the switch SW1 is on, the image data applied is the red data R1, and in the T1 to T2 period during which the switch SW2 is on, the image data applied is the red data R2. On the other hand, in the T2 to T3 period during which the switch SW1 is on, the image data applied is the green data G1, and in the T3 to T4 period during which the switch SW2 is on, the image data applied is the green data G2. Further, in the T4 to T5 period during which the switch SW1 is on, the image data applied is the blue data B1, and in the T5 to T6 period during which the switch SW2 is on, the image data applied is the blue data B2.

On the other hand, in the color light source 11 also, only one of the three color LEDS 11R, 11G, and 11B emits light at any instant in time. In the present embodiment, the red LED 11R emits light during the period from time T0 to time T2 in which the red data R1 and R2 are applied; the green LED 11G emits light during the period from time T2 to time T4 in which the green data G1 and G2 are applied; and the blue LED 11B emits light during the period from time T4 to time T6 in which the blue data B1 and B2 are applied. In this way, the three color LEDs 11R, 11G, and 11B in the color light source 11 emit lights in sequence in accordance with the respective color data to be output on the data line 38.

When the data voltage, i.e., image data, is applied with either one of the switches SW1 or SW2 in the ON state, the corresponding one of the two liquid crystal pixels 31A and 31B is opened, allowing the colored light emitted from the corresponding LED to pass through for exposure on the photosensitive member 14.

Accordingly, the liquid crystal pixel 31A is opened in accordance with the red data R1 during the period from time T0 to time T1, and transmits the red light emitted from the LED 11R to expose the photosensitive member 14 in accordance with the red data R1, and the liquid crystal pixel 31A is again opened in accordance with the green data G1 during the period from time T2 to time T3, and transmits the green light emitted from the LED 11G to expose the photosensitive member 14 in accordance with the green data G1; further, the liquid crystal pixel 31A is opened in accordance with the blue data B1 during the period from time T4 to time T5, and transmits the blue light emitted from the LED 11B to expose the photosensitive member 14 in accordance with the blue data B1.

On the other hand, the liquid crystal pixel 31B is opened in accordance with the red data R2 during the period from time T1 to time T2, and transmits the red light emitted from the LED 11R to expose the photosensitive member 14 in accordance with the red data R2, and the liquid crystal pixel 31B is again opened in accordance with the green data G2 during the period from time T3 to time T4, and transmits the green light emitted from the LED 11G to expose the photosensitive member 14 in accordance with the green data G2; further, the liquid crystal pixel 31B is opened in accordance with the blue data B2 during the period from time T5 to time T6, and transmits the blue light emitted from the LED 11B to expose the photosensitive member 14 in accordance with the blue data B2.

In this way, in the present embodiment, the two liquid crystal pixels in each pixel group PG sequentially expose the photosensitive member 14 first in accordance with the red data, then in accordance with the green data, and then in accordance with the blue data; this operation is repeated with a prescribed cycle.

The above has described the exposure operation performed on the photosensitive member 14 during the write period WF, and this operation is repeated after that. That is, in the fifth embodiment, since the number of liquid crystal pixels in each pixel group PG is 2, the write period WF required to complete the color exposures on the photosensitive member 14 is determined by the product of the division period (F1=F2), during which the time-division lines 35 and 36 are driven in time-division fashion, and the number of colors, three, of the color light source 11, the write period WF thus being equal to three times the division period.

In the fifth embodiment also, the exposure with the image data of the same color always starts at the same position when viewed along the direction orthogonal to the moving direction X of the liquid crystal pixel array 30. This is because the relation H=h/NM=h/6 holds, where h is the distance over which the photosensitive member 14 relatively moves during the write period WF, N is the number of liquid crystal pixels in each pixel group (N=2 in the present embodiment), M is the number of colors produced by the color light source (M=3 in the present embodiment), and H is the distance by which the liquid crystal pixels are displaced relative to each other.

In the present embodiment, L is set equal to h. While it is desirable that the length L of each liquid crystal pixel 31 in the liquid crystal pixel array 30, measured along the direction of the relative movement, be set equal to the distance h, the length L may not necessarily be made equal to the distance h.

(6) Embodiment 6

Next, a sixth embodiment of the present invention will be described; in this embodiment, the liquid crystal pixels 31 constituting the liquid crystal pixel array 30 are divided into pixel groups PG of four pixels each, and the four liquid crystal pixels 31 in each pixel group PG are arranged one displaced from another by L/12 (L is the length of each liquid crystal pixel 31 measured along the direction of the relative movement of the photosensitive member). In this embodiment, the color exposures are performed using procedures different to those described in the first to third embodiments.

Figure 23A:
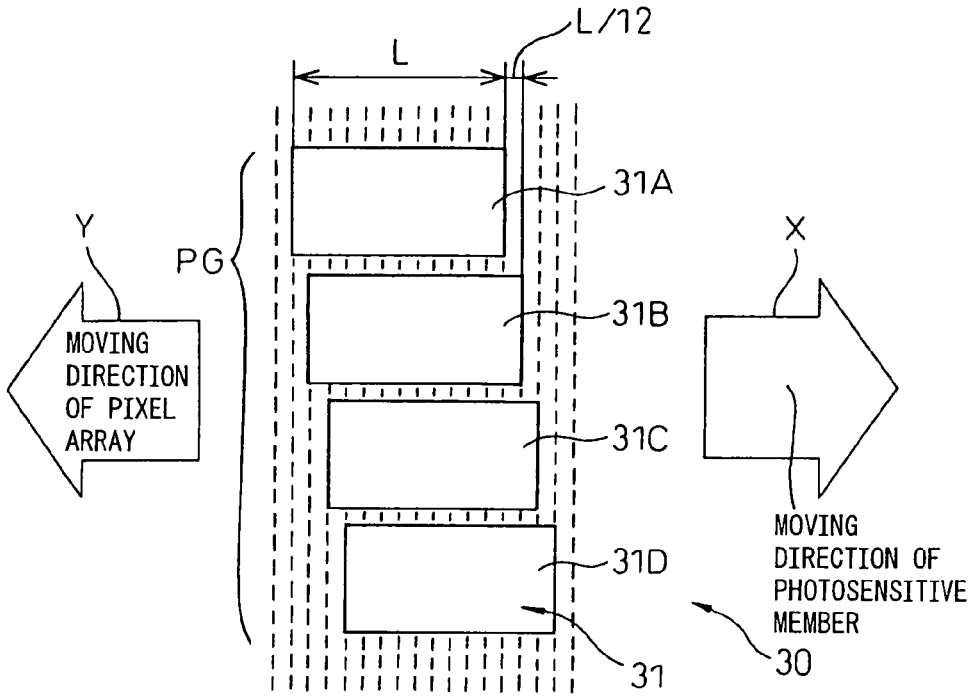
FIG. 23A is an enlarged plan view showing partially an arrangement of liquid crystal pixels in the liquid crystal shutter according to a sixth embodiment of the present invention.

FIG. 23A is an enlarged view showing the configuration of the liquid crystal pixel array 30 in the liquid crystal shutter according to the sixth embodiment of the present invention. In this embodiment, the liquid crystal pixels 31 constituting the liquid crystal pixel array 30 are divided into pixel groups PG of four pixels each. As shown, the four liquid crystal pixels 31 in each pixel group PG are arranged one displaced from another by L/12, where L is the overall length of each liquid crystal pixel 31 measured along the direction of the relative movement of the photosensitive member. The direction in which the liquid crystal pixels 31 are displaced is the same as the moving direction of the photosensitive member (shown by arrow X in FIG. 23A), that is, the direction from the upstream to the downstream side. More specifically, in the same pixel group PG, the liquid crystal pixel 31B adjacent to the liquid crystal pixel 31A is displaced by L/12 in the downstream direction; likewise, the liquid crystal pixels 31C and 31D are displaced by L/12 relative to the liquid crystal pixels 31B and 31C, respectively. The position of the first liquid crystal pixel (not shown) in the adjacent pixel group PG is the same as the position of the liquid crystal pixel 31A. The same applies to the case in which the liquid crystal pixel array 30 is moved relative to the photosensitive member in the direction shown by arrow Y in FIG. 23A.

Figure 23B:
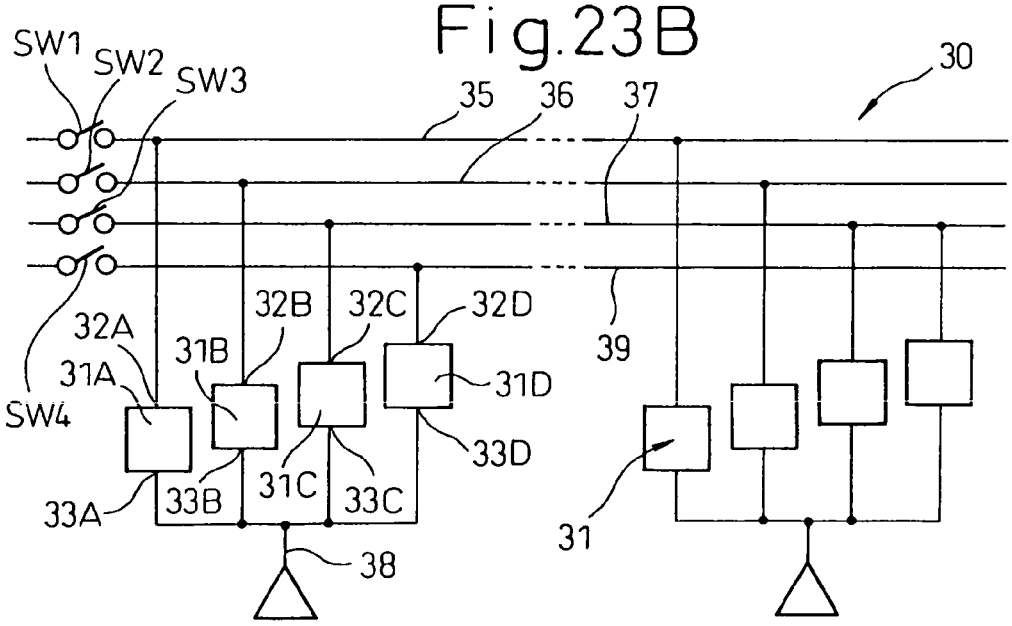
FIG. 23B is a diagram showing the configuration of a driving circuit for the liquid crystal shutter shown in FIG. 23A.

FIG. 23B is a diagram showing the configuration of a driving circuit for the liquid crystal pixel array 30 in the liquid crystal shutter shown in FIG. 23A. In the liquid crystal pixel array 30, the liquid crystal pixels 31 constituting the liquid crystal pixel array 30 are divided into pixel groups PG of four pixels each. When the four liquid crystal pixels 31 in each pixel group PG are denoted, for example, as the liquid crystal pixels 31A, 31B, 31C, and 31D, respectively, one electrode 32A of the liquid crystal cell forming the liquid crystal pixel 31A is connected to a first time-division line 35, one electrode 32B of the liquid crystal cell forming the liquid crystal pixel 31B is connected to a second time-division line 36, one electrode 32C of the liquid crystal cell forming the liquid crystal pixel 31C is connected to a third time-division line 37, and one electrode 32D of the liquid crystal cell forming the liquid crystal pixel 31D is connected to a fourth time-division line 39. The other electrodes 33A, 33B, 33C, and 33D of the liquid crystal pixels 31A, 31B, 31C, and 31D in the same pixel group PG are connected together, and then connected via a data line 38 to a corresponding one of the driver ICs 24 shown in FIG. 4A. The four liquid crystal pixels 31 in the adjacent pixel group PG are also connected in the same manner.

When the switch SW1 provided in the first time-division line 35 is on (the first time-division line 35 is selected), the liquid crystal pixels 31, which are connected in the respective pixel groups PG to the first time-division line 35, reach a light transmitting state. On the other hand, when the switch SW2 provided in the second time-division line 36 is on (the second time-division line 36 is selected), the liquid crystal pixels 31, which are connected in the respective pixel groups PG to the second time-division line 36, reach a light transmitting state. Further, when the switch SW3 provided in the third time-division line 37 is on (the third time-division line 37 is selected), the liquid crystal pixels 31, which are connected in the respective pixel groups PG to the third time-division line 37, reach a light transmitting state. Likewise, when the switch SW4 provided in the fourth time-division line 39 is on (the fourth time-division line 39 is selected), the liquid crystal pixels 31, which are connected in the respective pixel groups PG to the fourth time-division line 39, reach a light transmitting state.

In this way, in the sixth embodiment, only one electrode in each pixel group PG is connected to the driver IC 24; therefore, when each pixel group PG consists of four liquid crystal pixels 31, the total number of driver IC output pins can be reduced to one quarter the total number of liquid crystal pixels 31 contained in the liquid crystal pixel array 30. Here, each driver IC 24 has 160 drive pins; therefore, if the liquid crystal pixel array 30 consists of 480 pixels, then 480÷4=120, that is, only one driver IC need be provided. This means that the three driver ICs 24 shown in FIGS. 3 and 4 can be replaced in this embodiment by one driver IC, and a substantial reduction in cost can thus be achieved.

Figure 24:
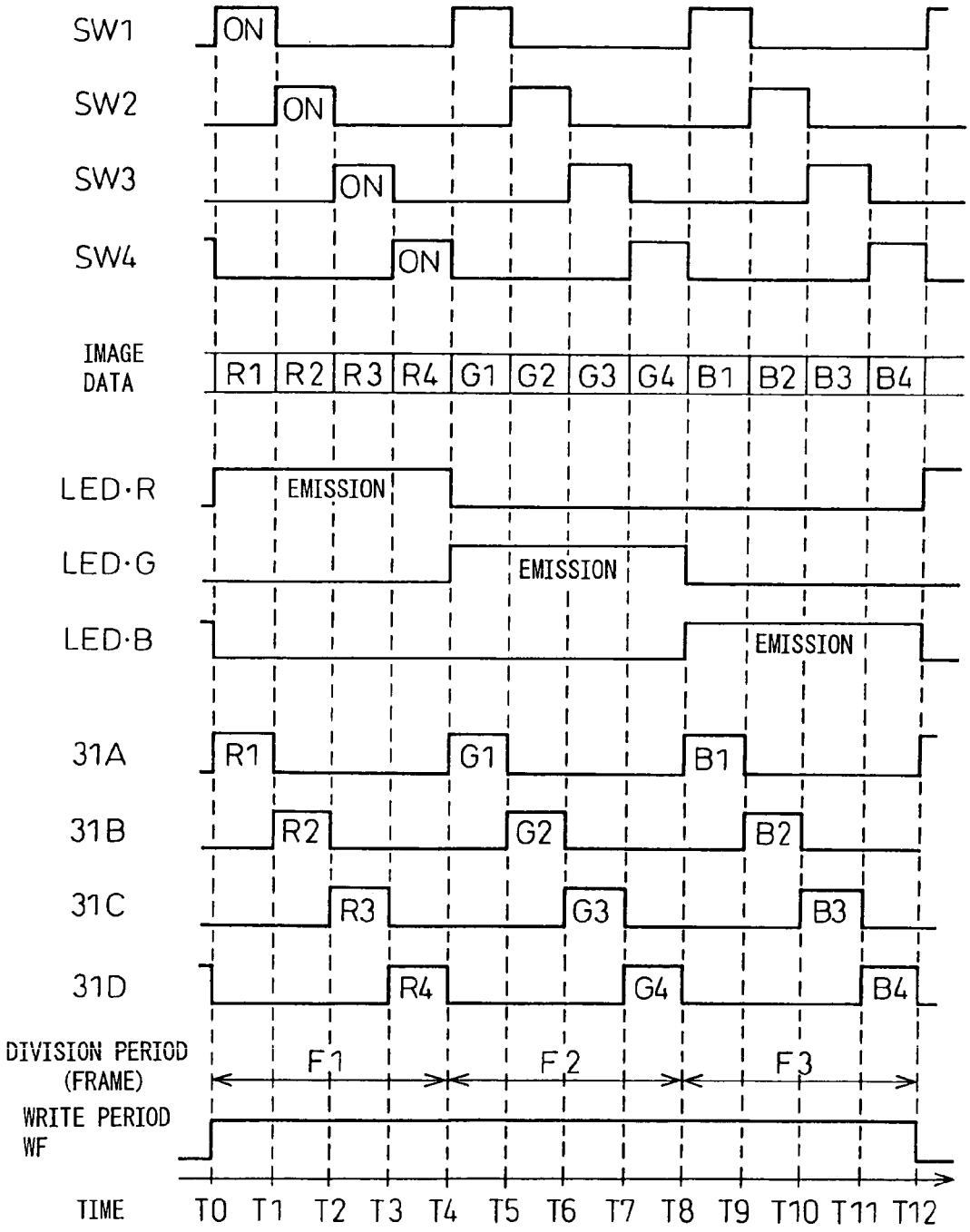
FIG. 24 is a waveform diagram showing driving waveforms for three adjacent liquid crystal pixels in the liquid crystal shutter according to the sixth embodiment of the present invention shown in FIG. 21.

FIG. 24 is a waveform diagram showing driving waveforms for various parts when the driver IC drives the four adjacent liquid crystal pixels contained in one pixel group PG in the liquid crystal pixel array 30 shown in FIG. 23B. The driving waveforms only for one pixel group PG will be described here, as the driving waveforms for the liquid crystal pixels 31 in the other pixel groups PG are exactly the same as those shown here.

In the sixth embodiment also, the selected/unselected states of the first to fourth time-division lines 35 to 37 and 39 shown in FIG. 23B will be described in conjunction with the operations of the switches SW1 to SW4 provided in the respective lines. At any instant in time, only one of the switches SW1 to SW4 is on, and the other switches remain off. During the period from time T0 to time T1, the switch SW1 is on; during the period from time T1 to time T2, the switch SW2 is on; during the period from time T2 to time T3, the switch SW3 is on; and during the period from time T3 to time T4, the switch SW4 is on. The length of the ON period is the same for each of the switches SW1 to SW4. When the ON period of the switch SW4 ends at time T4, the switch SW1 again turns on at time T4 and remains on till time T5. After that, the switch SW2 is on from time T5 to time T6; thereafter, the switches SW1 to SW4 repeatedly cycle between the ON and OFF states in like manner.

Next, a description will be given of the image data applied from the driver IC to the data line 38. In the T0 to T1 period during which the switch SW1 is on, the image data applied is the red data R1; in the T1 to T2 period during which the switch SW2 is on, the image data applied is the red data R2; in the T2 to T3 period during which the switch SW3 is on, the image data applied is the red data R3; and in the T3 to T4 period during which the switch SW4 is on, the image data applied is the red data R4. On the other hand, in the T4 to T5 period during which the switch SW1 is on, the image data applied is the green data G1; in the T5 to T6 period during which the switch SW2 is on, the image data applied is the green data G2; in the T6 to T7 period during which the switch SW3 is on, the image data applied is the green data G3; and in the T7 to T8 period during which the switch SW4 is on, the image data applied is the green data G4. Further, in the T8 to T9 period during which the switch SW1 is on, the image data applied is the blue data B1; in the T9 to T10 period during which the switch SW2 is on, the image data applied is the blue data B2; in the T10 to T11 period during which the switch SW3 is on, the image data applied is the blue data B3; and in the T11 to T12 period during which the switch SW4 is on, the image data applied is the blue data B4.

On the other hand, in the color light source 11 also, only one of the three color LEDs 11R, 11G, and 11B emits light at any instant in time. In the sixth embodiment, the red LED 11R emits light during the period from time T0 to time T4 in which the red data R1 to R4 are applied; the green LED 11G emits light during the period from time T4 to time T8 in which the green data G1 to G4 are applied; and the blue LED 11B emits light during the period from time T8 to time T12 in which the blue data B1 to B4 are applied. In this way, the three color LEDs 11R, 11G, and 11B in the color light source 11 emit light in sequence in accordance with the respective color data to be output on the data line 38.

When the data voltage, i.e., image data, is applied with one of the switches SW1 to SW4 in the ON state, the corresponding one of the four liquid crystal pixels 31A to 31D is opened, allowing the colored light emitted from the corresponding LED to pass through for exposure on the photosensitive member 14.

Accordingly, during the period from time T0 to time T1, the liquid crystal pixel 31A transmits the red light emitted from the LED 11R to expose the photosensitive member 14 in accordance with the red data R1; during the period from time T4 to time T5, the liquid crystal pixel 31A transmits the green light emitted from the LED 11G to expose the photosensitive member 14 in accordance with the green data G1; and during the period from time T8 to time T9, the liquid crystal pixel 31A transmits the blue light emitted from the LED 11B to expose the photosensitive member 14 in accordance with the blue data B1.

On the other hand, during the period from time T1 to time T2, the liquid crystal pixel 31B transmits the red light emitted from the LED 11R to expose the photosensitive member 14 in accordance with the red data R2; during the period from time T5 to time T6, the liquid crystal pixel 31B transmits the green light emitted from the LED 11G to expose the photosensitive member 14 in accordance with the green data G2; and during the period from time T9 to time T10, the liquid crystal pixel 31B transmits the blue light emitted from the LED 11B to expose the photosensitive member 14 in accordance with the blue data B2.

Further, during the period from time T2 to time T3, the liquid crystal pixel 31C transmits the red light emitted from the LED 11R to expose the photosensitive member 14 in accordance with the red data R3; during the period from time T6 to time T7, the liquid crystal pixel 31C transmits the green light emitted from the LED 11G to expose the photosensitive member 14 in accordance with the green data G3; and during the period from time T10 to time T11, the liquid crystal pixel 31C transmits the blue light emitted from the LED 11B to expose the photosensitive member 14 in accordance with the blue data B3.

Likewise, during the period from time T3 to time T4, the liquid crystal pixel 31D transmits the red light emitted from the LED 11R to expose the photosensitive member 14 in accordance with the red data R4; during the period from time T7 to time T8, the liquid crystal pixel 31D transmits the green light emitted from the LED 11G to expose the photosensitive member 14 in accordance with the green data G4; and during the period from time T11 to time T12, the liquid crystal pixel 31D transmits the blue light emitted from the LED 11B to expose the photosensitive member 14 in accordance with the blue data B4.

In this way, in the sixth embodiment, the four liquid crystal pixels in each pixel group PG sequentially expose the photosensitive member 14 first in accordance with the red data, then in accordance with the green data, and then in accordance with the blue data; this operation is repeated with a prescribed cycle.

The above has described the exposure operation performed on the photosensitive member 14 during the write period WF, and this operation is repeated after that. That is, in the sixth embodiment, since the number of liquid crystal pixels in each pixel group PG is 4, the write period WF required to complete the color exposures on the photosensitive member 14 is determined by the product of the division period (F1=F2=F3=F4), during which the time-division lines 35 to 37 and 39 are driven in time-division fashion, and the number of colors, three, of the color light source 11, the write period WF thus being equal to three times the division period.

In the sixth embodiment also, the exposure with the image data of the same color always starts at the same position when viewed along the direction orthogonal to the moving direction X of the liquid crystal pixel array 30. This is because the relation H=h/NM=h/12 holds, where h is the distance over which the photosensitive member 14 relatively moves during the write period WF, N is the number of liquid crystal pixels in each pixel group (N=4 in the present embodiment), M is the number of colors produced by the color light source (M=3 in the present embodiment), and H is the distance by which the liquid crystal pixels are displaced relative to each other.

In the present embodiment, L is set equal to h. While it is desirable that the length L of each liquid crystal pixel 31 in the liquid crystal pixel array 30, measured along the direction of the relative movement, be set equal to the distance h, the length L may not necessarily be made equal to the distance h.

The present invention has been described above for the cases of N=3 (fourth embodiment), N=2 (fifth embodiment), and N=4 (sixth embodiment), but it will be appreciated that, in the exposure procedures described above, the number N is not limited to those given in the respective embodiments.

As described above with reference to the first to sixth embodiments, according to the liquid crystal exposure apparatus of the present invention, the liquid crystal pixel array is divided into a plurality of pixel groups each consisting of N liquid crystal pixels, and each pixel group is driven by a driver IC. Accordingly, compared with the case where each individual liquid crystal pixel is driven by a driver IC, the number of driver IC pins can be reduced to 1/N. Since this serves to reduce the total number of driver ICs, the cost of the liquid crystal exposure apparatus can be reduced.

What is claimed is:

1. A liquid crystal exposure apparatus for exposing a photosensitive member during a relative movement thereof, comprising:

a color light source for emitting a plurality of colored lights;

a liquid crystal shutter having a plurality of liquid crystal pixels arrayed in a direction orthogonal to the direction of said relative movement; and a driving circuit for switching said color light source from one colored light to another, and for driving said plurality of liquid crystal pixels, wherein said plurality of liquid crystal pixels are divided into a plurality of pixel groups of N liquid crystal pixels each, said N liquid crystal pixels in each pixel group being arrayed, one displaced from another by a prescribed distance, in the direction orthogonal to the direction of said relative movement, and said driving circuit drives a plurality of liquid crystal pixels having the same displaced position in said plurality of pixel groups at a time in time-division fashion.

2. The liquid crystal exposure apparatus according to claim 1, wherein each of said plurality of liquid crystal pixels has a first electrode and a second electrode, the first electrodes of said plurality of liquid crystal pixels are connected in common to said driving circuit, the second electrodes of said liquid crystal pixels having the same displaced position in said plurality of pixel groups are all connected to a corresponding one of N time-division lines, and said driving circuit drives said plurality of liquid crystal pixels in time-division fashion by switching between said N time-division lines.

3. The liquid crystal exposure apparatus according to claim 2, wherein said driving circuit switches between said time-division lines while any particular one of said colored lights of said color light source is selected.

4. The liquid crystal exposure apparatus according to claim 3, wherein a write period WF required to complete the exposure of said photosensitive member by all of liquid crystal pixels of said pixel groups is determined by the product of a division period F, during which said time-division lines are switched from one line to another, and the number, M, of colored lights that said color light source emits.

5. The liquid crystal exposure apparatus according to claim 4, wherein the distance H by which said liquid crystal pixels are displaced from each other satisfies the relation H=h/NM, where h denotes the distance over which said photosensitive member relatively moves during said write period WF, N the number of liquid crystal pixels in each of said pixel groups, and the number, M, of colored lights that said color light source emits.

6. The liquid crystal exposure apparatus according to claim 4, wherein the direction in which said liquid crystal pixels are displaced in each of said pixel groups is a downstream direction when viewed along the direction of said relative movement of said photosensitive member.

7. The liquid crystal exposure apparatus according to claim 4, wherein the length of each of said liquid crystal pixels in said liquid crystal pixel array, as measured along the direction of said relative movement, is equal to the distance h over which said photosensitive member relatively moves during said write period WF.

8. The liquid crystal exposure apparatus according to claim 4, wherein the number, M, of colored lights is 3, and the number, N, of liquid crystal pixels in each of said pixel groups is 3.

9. The liquid crystal exposure apparatus according to claim 4, wherein the number, M, of colored lights is 3, and the number, N, of liquid crystal pixels in each of said pixel groups is 2.

10. The liquid crystal exposure apparatus according to claim 4, wherein the number, M, of colored lights is 3, and the number, N, of liquid crystal pixels in each of said pixel groups is 4.

11. The liquid crystal exposure apparatus according to claim 2, wherein said driving circuit switches said color light source between said plurality of colored lights while any particular one of said time-division lines is selected.

12. The liquid crystal exposure apparatus according to claim 11, wherein a write period WF required to complete the exposure of said photosensitive member by all of said liquid crystal pixels of said pixel groups is equal to the sum of selection periods of all of said time-division lines.

13. The liquid crystal exposure apparatus according to claim 12, wherein said driving circuit switches said color light source from one color to another in a time equal to an Mth submultiple of the selection period of each of said time-division lines, where M denotes the number of colored lights that said color light source emits.

14. The liquid crystal exposure apparatus according to claim 13, wherein the distance H by which said liquid crystal pixels are displaced in each of said pixel groups satisfies the relation H=h/N, where h denotes the distance over which said photosensitive member relatively moves during said write period, and N the number of liquid crystal pixels in each of said pixel groups.

15. The liquid crystal exposure apparatus according to claim 13, wherein the direction in which said liquid crystal pixels are displaced in each of said pixel groups is a downstream direction when viewed along the direction of said relative movement of said photosensitive member.

16. The liquid crystal exposure apparatus according to claim 13, wherein the length of each of said liquid crystal pixels in said liquid crystal pixel array, as measured along the direction of said relative movement, is equal to the distance h over which said photosensitive member relatively moves during said write period.

17. The liquid crystal exposure apparatus according to claim 11, wherein the number, M, of colored lights is 3, and the number, N, of liquid crystal pixels in each of said pixel groups is 3.

18. The liquid crystal exposure apparatus according to claim 11, wherein the number, M, of colored lights is 3, and the number, N, of liquid crystal pixels in each of said pixel groups is 2.

19. The liquid crystal exposure apparatus according to claim 11, wherein the number, M, of colored lights is 3, and the number, N, of liquid crystal pixels in each of said pixel groups is 4.

* * * * *